US011174641B2

(12) United States Patent
Agee

(10) Patent No.: US 11,174,641 B2
(45) Date of Patent: Nov. 16, 2021

(54) ADJUSTABLE REBAR CENTRALIZER FOR USE IN A DRILLED SHAFT/BORE HOLE

(71) Applicant: Pieresearch1, LP, Arlington, TX (US)

(72) Inventor: Stanley D. Agee, Arlington, TX (US)

(73) Assignee: Pieresearch1, LP, Arlington, TX (US)

( * ) Notice: Subject to any disclaimer, the term of this patent is extended or adjusted under 35 U.S.C. 154(b) by 147 days.

(21) Appl. No.: 16/814,816

(22) Filed: Mar. 10, 2020

(65) Prior Publication Data

US 2020/0208404 A1 Jul. 2, 2020

Related U.S. Application Data

(63) Continuation-in-part of application No. 16/200,981, filed on Nov. 27, 2018, now Pat. No. 10,584,459, which is a continuation-in-part of application No. 15/458,775, filed on Mar. 14, 2017, now Pat. No. 10,151,113.

(60) Provisional application No. 62/632,324, filed on Feb. 19, 2018, provisional application No. 62/308,737, filed on Mar. 15, 2016.

(51) Int. Cl.

| | |
|---|---|
| ***E21B 17/10*** | (2006.01) |
| ***E02D 13/00*** | (2006.01) |
| ***E02D 17/20*** | (2006.01) |
| ***E02D 5/80*** | (2006.01) |
| ***E04C 5/20*** | (2006.01) |

(52) U.S. Cl.

CPC ..... *E04C 5/203* (2013.01); *E02D 5/80* (2013.01); *E02D 17/207* (2013.01); *E21B 17/10* (2013.01); *E21B 17/105* (2013.01); *E21B 17/1078* (2013.01)

(58) Field of Classification Search

CPC ..... E04C 5/203; E04C 5/163; E04C 5/162; E04C 5/161; E04C 5/16; E21B 17/1042; E21B 17/105; E21B 17/1078; E21B 17/1057; E21B 17/10; E02D 13/00; E02D 17/207; E02D 5/80; E02D 5/808

See application file for complete search history.

(56) References Cited

U.S. PATENT DOCUMENTS

| | | | | |
|---|---|---|---|---|
| 3,055,432 A | | 9/1962 | Park | |
| 3,556,042 A | * | 1/1971 | Laughlin | E21B 17/1028 166/241.7 |
| 4,042,022 A | * | 8/1977 | Wills | E21B 17/1014 166/241.7 |
| 4,077,470 A | | 3/1978 | Dane | |
| 4,088,186 A | | 5/1978 | Callihan et al. | |
| 4,247,225 A | | 1/1981 | Chickini, Jr. et al. | |

(Continued)

OTHER PUBLICATIONS

C&M Manufacturing Co., "C&M Duraflex PVC Centralizers, The Industry Standard Developed by C&M Mfg. Co.", 2010, 6 pages.

(Continued)

*Primary Examiner* — Phi D A

(74) *Attorney, Agent, or Firm* — Slater Matsil, LLP

(57) ABSTRACT

A system for centering a reinforcing member within a drilled shaft/bore hole includes a first cage member and a second cage member. The first cage member is operable to surround a first half of the reinforcing member. The second cage member is operable to surround a second half of the reinforcing member. The second cage member is operably connected to the first cage member, and the first and second cage members have identical shapes.

20 Claims, 39 Drawing Sheets

(56) References Cited

U.S. PATENT DOCUMENTS

| | | | | |
|---|---|---|---|---|
| 4,651,823 | A | 3/1987 | Spikes | |
| 4,909,322 | A | 3/1990 | Patterson et al. | |
| 5,542,785 | A | 8/1996 | Cloud | |
| 6,102,118 | A | 8/2000 | Moore | |
| 6,257,792 | B1 | 7/2001 | Read, Jr. | |
| 6,299,386 | B1 | 10/2001 | Byrne et al. | |
| 6,367,556 | B1 | 4/2002 | Moore | |
| 6,457,519 | B1 | 10/2002 | Buytaert | |
| 6,637,511 | B2 | 10/2003 | Linaker | |
| 6,679,325 | B2 | 1/2004 | Buytaert | |
| 6,997,254 | B2 | 2/2006 | Jenner | |
| 7,048,064 | B1 * | 5/2006 | Smith | E21B 17/1042 166/382 |
| 8,066,066 | B2 * | 11/2011 | Linaker | E21B 17/1021 166/241.1 |
| D662,952 | S | 7/2012 | Kirk et al. | |
| 8,245,777 | B2 * | 8/2012 | Garner | E21B 17/1028 166/213 |
| 8,262,308 | B2 | 9/2012 | Peng | |
| D671,960 | S | 12/2012 | Kirk et al. | |
| 8,770,280 | B2 | 7/2014 | Buytaert et al. | |
| 8,919,437 | B2 | 12/2014 | MacLeod | |
| 9,249,575 | B2 | 2/2016 | Hutchison et al. | |
| 9,249,633 | B1 | 2/2016 | Arizmendi | |
| 9,341,032 | B2 | 5/2016 | Jewett | |
| 9,771,763 | B2 | 9/2017 | McDaniel et al. | |
| 10,151,113 | B2 | 12/2018 | Agee | |
| 2010/0018698 | A1 | 1/2010 | Gamer | |
| 2015/0284958 | A1 | 10/2015 | Hutchison et al. | |
| 2017/0268235 | A1 | 9/2017 | Agee | |

OTHER PUBLICATIONS

Weatherford International, "Rigid-Bar Centralizer," Cementing Products, 2012, 2 pages.

Pegasus Vertex, Inc., "Casing Centralizer Series—1: Types of Centralizers", Jan. 13, 2015, http://www.pvisoftware.com/blog/tag/choose-the-right-type of-centralizer, 3 pages.

* cited by examiner

ADJUSTABLE REBAR CENTRALIZER FOR USE IN A DRILLED SHAFT/BORE HOLE

CROSS-REFERENCE TO RELATED APPLICATIONS

This application is a continuation-in-part of U.S. application Ser. No. 16/200,981, filed Nov. 27, 2018 (now U.S. Pat. No. 10,584,459, issued Mar. 10, 2020), which claims the benefit of U.S. Application No. 62/632,324, filed Feb. 19, 2018 and is also a continuation-in-part of U.S. application Ser. No. 15/458,775, filed on Mar. 14, 2017 (now U.S. Pat. No. 10,151,113, issued Dec. 11, 2018), which claims the benefit of U.S. Application No. 62/308,737, filed on Mar. 15, 2016, which applications are hereby incorporated herein by reference.

TECHNICAL FIELD

The present invention relates to an adjustable rebar centralizer, for example, for use in a drilled shaft/bore hole to centralize a single rebar member in the drilled shaft/bore hole.

BACKGROUND

Earth retention systems provide shoring for excavation support and reinforcement for the permanent stabilization of deep cuts and slopes. Soil nailing supports excavations and provides slope stability control. Deep foundations transfer building loads to a subsurface layer of the earth beneath the surface.

Soil nailing is a construction technique that inserts reinforcing bars (rebar), which may be high-strength steel bar or steel strand tendon, into a drilled shaft/bore hole to provide permanent or temporary support to unstable or potentially unstable slopes. Soil nailing may be used, for example, to stabilize slopes and landslides, provide earth retention for excavations, and repair existing retaining walls. A type of deep foundation is created by drilling a hole/shaft into the earth to bedrock and filling the hole/shaft with a single rod of rebar. The drilled shaft/bore hole is then filled with grout or concrete to affix the rebar in place.

Without proper alignment of the rebar within the drilled shaft/bore hole, the rebar cannot perform the function for which it was designed or may become compromised over time due to corrosion and/or misalignment. Because the rebar is surrounded by grout or concrete, the position of the rebar within the drilled shaft/bore hole cannot be inspected after the grout has been placed within the drilled shaft/bore hole.

U.S. Pat. No. 6,299,386 discloses a method and apparatus for shoring a wall. The method includes inserting retaining elements substantially vertically and side by side into an earthen mass to shore the face of an excavation. Soil nails are then inserted into the excavation plane, at the approximate midpoint between a pair of adjacent retaining elements. The soil nails include a threaded core element that receives at least two centralizers. An exposed tip portion of each soil nail attaches to a wall, which is a substantially horizontal element that contacts a retaining element on both sides of each soil nail. The concrete reinforcement bars can then receive a concrete fill to form a solid wale structure. Face stability is achieved with the pre-installed retaining elements, which with the wales provide complete facing support.

A rebar centralizer is disclosed in U.S. Patent Publ. No. 2015/0284958. In this document, a rebar centralizer system comprises a first ring and a second ring configured to be positioned in an angular relationship with each other. The first and second rings are configured to at least partially intersect so as to present at least one interior corner in which a section of rebar can be secured.

U.S. Pat. No. 5,542,785 discloses a rebar cage wheel spacer centralizer system for drilled shafts. In this document, a spacer is mounted on a lateral rebar tie of a reinforcement cage of a poured concrete foundation support. The spacer includes a pair of interlocking wheel members which lock the wheel members together in a mated interlocked relationship rotatably mounted about a lateral tie of the reinforcement cage to form the spacer. Each spacer is formed from a pair of substantially identical substantially semi-cylindrically shaped interlocking wheel members which, when assembled, form rotatable wheel assemblies. As the reinforcement cage is inserted into an excavated shaft, the outer side wall of the spacer engages and rolls along the side wall thereof. The engagement of the side wall of the excavated shaft by the spacers centers the reinforcement cage within the excavated shaft and maintains the reinforcement cage in its centered position as the excavated shaft is filled with concrete.

U.S. Pat. No. 10,151,113 discloses a system for centering a reinforcing member within a drilled shaft/bore hole includes a first cage member and a second cage member. The first cage member is operable to surround a first half of the reinforcing member. The second cage member is operable to surround a second half of the reinforcing member. The second cage member is operably connected to the first cage member, and the first and second cage members have identical shapes.

SUMMARY

According to a first embodiment, a cage member can be used in a system for centering a reinforcing member within a drilled shaft/bore hole. The cage member includes a plurality portions. The cage member includes a first neck portion, a second neck portion spaced from the first neck portion along a central axis, a first collar portion adjacent the first neck portion, and a second collar portion adjacent the second neck portion. The first collar portion and second collar portion each having a plurality of sockets extending outwardly relative to the central axis. A first elongated tab extends from a region adjacent a first lateral edge of the first collar portion. The first elongated tab includes a plurality of teeth. A first slot extends from a region adjacent a second lateral edge of the first collar portion. The second lateral edge is spaced from the first lateral edge by the first collar portion. A second elongated tab extends from a region adjacent a first lateral edge of the second collar portion. The second elongated tab includes a plurality of teeth. A second slot extends from a region adjacent a second lateral edge of the second collar portion. The second lateral edge is spaced from the first lateral edge by the second collar portion. A plurality of arm portions extends from the first collar portion to the second collar portion. The arm portion connects to the socket on the first collar portion on one end of the arm portion to the socket on the second collar portion on the opposing end of the arm portion. The first and second neck portions, the first and second collar portions, the first and second tabs, the first and second slots, and the arm portions of the cage member are the portions of the single member. The first and second collar portions are formed symmetrically so that the cage member can be interlocked with a substantially identical cage member so as to form a centralizing cage.

According to another embodiment, a centralizing cage can be used in centering a reinforcing member within a drilled shaft/bore hole. The centralizing cage includes a first centralizing member having a first end and an opposing second end. The first centralizing member includes a neck that is configured to surround a first half of a diameter of a plurality of different sized reinforcing members. A second centralizing member has a first end and a second opposing end. The second centralizing member includes a neck portion that is configured to surround a second half of the diameter of the each of the reinforcing members. The neck portion of the first centralizing member and the neck portion of the second centralizing member are shaped so that the neck portion of the first centralizing member and the neck portion of the second centralizing member surround the diameter of the reinforcing member when the first and second centralizing members are attached. The second centralizing member is substantially identical to the first centralizing member.

According to another embodiment, a centralizing cage can be used in centering a reinforcing member within a drilled shaft/bore hole. The centralizing cage system includes first and second substantially identical centralizing members. The first centralizing member includes a plurality of arm portions extending between a first collar portion and a second collar portion, a first neck portion extending from the first collar portion and a second neck portion extending from the second collar portion. The second centralizing member includes a plurality of arm portions extending between a first collar portion and a second collar portion, a first neck portion extending from the first collar portion and a second neck portion extending from the second collar portion. The first collar portion and the second collar portion of the first centralizing member include a plurality of sockets configured to connect a first end of the plurality of arm portions to the first collar portion and a second end of the plurality of arm portions to the second collar portion. The first collar portion and the second collar portion of the second centralizing member include a plurality of sockets configured to connect a first end of the plurality of arm portions to the first collar portion and a second end of the plurality of arm portions to the second collar portion. The centralizing cage system can vary in length and diameter by selecting a length and radius of curvature for the plurality of arm portions. The first collar portion of the first centralizing member includes a first elongated tab and a first slot and the second collar portion of the first centralizing member includes a second elongated tab and a second slot. The first elongated tab and the second elongated tab of the first collar portion each include a plurality of teeth. The first collar portion of the second centralizing member includes a first elongated tab and a first slot and the second collar portion of the second centralizing member includes a second elongated tab and a second slot. The first elongated tab and the second elongated tab of the second collar portion each include a plurality of teeth. The first elongated tab of the first centralizing member is configured to join with the second slot of the second centralizing member. The first slot of the first centralizing member is configured to receive the second elongated tab of the second centralizing member. The second elongated tab of the first centralizing member is configured to join with the first slot of the second centralizing member. The second slot of the first centralizing member is configured to receive the first elongated tab of the second centralizing member. The first and second centralizing cage members can be attached to adjustable diameters by varying the amount the elongated tabs are received within the slots.

According to another embodiment, a centralizer can be used in a system for centering a reinforcing member within a drilled shaft/bore hole. The centralizer includes a plurality of members. The centralizer includes a first retaining member, a second retaining member, a third retaining member, a fourth retaining member, a first plurality of separate arms, and a second plurality of separate arms. The first retaining member is a single member that includes a plurality of portions. The first retaining member includes a first neck portion having a concave shape relative to the center axis and a first collar portion adjacent the first neck portion. The first collar portion includes a plurality of sockets extending outwardly relative to the center axis. A first protrusion adjacent the first neck portion or the first collar portion and extends inward toward the center axis. The first protrusion configured to engage the reinforcing member when the centralizer is in use. A first elongated tab extends from a region adjacent a first lateral edge of the first collar portion. The first elongated tab includes a plurality of teeth. A first slot extends from a region adjacent a second lateral edge of the first collar portion, the second lateral edge spaced from the first lateral edge by the first collar portion. The second retaining member is a single member that includes a plurality of portions. The second retaining member includes a second neck portion having a concave shape relative to the center axis and a second collar portion adjacent the first neck portion. The second collar portion includes a plurality of sockets extending outwardly relative to the center axis. A second protrusion adjacent the second neck portion or the second collar portion and extends inward toward the center axis. The second protrusion configured to engage the reinforcing member when the centralizer is in use. A second elongated tab extends from a region adjacent a first lateral edge of the second collar portion. The second elongated tab includes a plurality of teeth. A second slot extends from a region adjacent a second lateral edge of the second collar portion, the second lateral edge spaced from the first lateral edge by the second collar portion. The third retaining member is a single member that includes a plurality of portions. The third retaining member includes a third neck portion having a concave shape relative to the center axis and a third collar portion adjacent the third neck portion. The third collar portion includes a plurality of sockets extending outwardly relative to the center axis. A third protrusion adjacent the third neck portion or the third collar portion and extends inward toward the center axis. The third protrusion configured to engage the reinforcing member when the centralizer is in use. A third elongated tab extends from a region adjacent a first lateral edge of the third collar portion. The third elongated tab includes a plurality of teeth. A third slot extends from a region adjacent a second lateral edge of the third collar portion, the second lateral edge spaced from the first lateral edge by the third collar portion. The fourth retaining member is a single member that includes a plurality of portions. The fourth retaining member includes a fourth neck portion having a concave shape relative to the center axis and a fourth collar portion adjacent the fourth neck portion. The fourth collar portion includes a plurality of sockets extending outwardly relative to the center axis. A fourth protrusion adjacent the fourth neck portion or the fourth collar portion and extends inward toward the center axis. The fourth protrusion configured to engage the reinforcing member when the centralizer is in use. A fourth elongated tab extends from a region adjacent a first lateral edge of the fourth collar portion. The fourth elongated tab includes a plurality of teeth. A fourth slot extends from a region adjacent a second lateral edge of the fourth collar portion, the second lateral edge spaced from the first lateral edge by the fourth collar portion. The first plurality of separate arms are single members. Each arm of the first plurality extends in the direction along the center axis and has a first end secured in a socket of the first retaining member and a second end secured in a socket of the second retaining member. The second plurality of separate arms are single members. Each arm of the second plurality extends in the direction along the center axis and has a first end secured in a socket of the third retaining member and a second end secured in a socket of the fourth retaining member. The first elongated tab can be connected within the third slot at so a first number of the plurality of teeth are on one side of the third slot and a remaining number of the plurality of teeth are on a opposite side of the third slot. The ratio of the first number to the remaining number of teeth of the first elongated tab can be determined by a diameter of the reinforcing member. The third elongated tab is connected within the first slot at so a first number of the plurality of teeth are on one side of the first slot and a remaining number of the plurality of teeth are on a opposite side of the first slot. The ratio of the first number to the remaining number of teeth of the third elongated tab is substantially the same as the ratio of the first number to the remaining number of teeth of the first elongated tab. The second elongated tab is connected within the fourth slot at so a first number of the plurality of teeth are on one side of the fourth slot and a remaining number of the plurality of teeth are on a opposite side of the fourth slot. The ratio of the first number to the remaining number of teeth of the second elongated tab can be determined by a diameter of the reinforcing member. The fourth elongated tab is connected within the second slot at so a first number of the plurality of teeth are on one side of the second slot and a remaining number of the plurality of teeth are on a opposite side of the second slot. The ratio of the first number to the remaining number of teeth of the fourth elongated tab is substantially the same as the ratio of the first number to the remaining number of teeth of the second elongated tab.

According to another embodiment, a centralizer arrangement can have a plurality of components that are connectable for use in a system for centering a reinforcing member within a drilled shaft/bore hole. The centralizer arrangement includes a plurality of retaining members. The retaining member is a single integral member that includes a neck portion having a concave shape relative to the center axis, a collar portion adjacent the neck portion and includes a plurality of sockets extending outwardly relative to the center axis, a protrusion adjacent the neck portion or the collar portion and extends inwardly toward the center axis. The protrusion configured to engage the reinforcing member when the centralizer is in use. An elongated tab extends from a region adjacent a first lateral edge of the collar portion. The elongated tab includes a plurality of teeth. A slot extends from a region adjacent a second lateral edge of the collar portion, the second lateral edge spaced from the first lateral edge by the collar portion. A first plurality of separate arms, each arm includes a first end connectable in a socket of the collar portion and a second end connectable in a socket of the collar portion. Each arm of the first plurality of separate arms includes a first radius of curvature. A second plurality of separate arms, each arm includes a first end connectable in a socket of the collar portion and a second end connectable in a socket of the collar portion. Each arm of the second plurality of separate arms includes a second radius of curvature that is different than the first radius of curvature. Four retaining members, includes first, second, third and fourth retaining members, are connectable with a plurality of arms to form a centralizer for a specific combination of a reinforcing member and a drilled shaft/bore hole. The centralizer configured so the neck portions and collar portions of the four retaining members surround the reinforcing member and the arms extend in the direction along the center axis and curve outward away from the reinforcing member. The plurality of arms to form the centralizer are all arms selected from the first plurality of arms or all arms selected from the second plurality of arms, the selection based on a radius of the drilled shaft/bore hold. The four retaining members are connectable by inserting the elongated tab of the first retaining member into the slot of the second retaining member by a first distance, inserting the elongated tab of the second retaining member into the slot of the first retaining member by the first distance, inserting the elongated tab of the third retaining member into the slot of the fourth retaining member by the first distance, and inserting the elongated tab of the fourth retaining member into the slot of the third retaining member by the first distance. The first distance can be based on a diameter of the reinforcing member.

According to another embodiment, a method for using a centralizing cage system can be used to centralize a reinforcing member along a center axis within a drilled shaft/bore hole. The method includes providing a plurality of substantially identical retaining members, providing a first plurality of separate arms, providing a second plurality of separate arms, selecting a plurality of centralizer arms based on diameter of the drilled shaft/bore hole, connecting half of the selected centralizer arms between a first retaining member and a second retaining member to form a first centralizing member, connecting the remaining half of the selected centralizer arms between a third retaining member and a fourth retaining member to form a second centralizing member, surrounding a first half of the reinforcing member with the first centralizing member and surrounding a second half of the reinforcing member with the second centralizing member, and connecting the first centralizing member and the second centralizing member around the reinforcing member by a distance based on the diameter of the reinforcing member. Each retaining member is a single integral member that includes a neck portion having a concave shape relative to the center axis and a collar portion adjacent the neck portion and includes a plurality of sockets that extend outwardly relative to the center axis. A protrusion adjacent the neck portion or the collar portion and extends inwardly toward the center axis. The protrusion configured to engage the reinforcing member when the centralizer is in use. An elongated tab extends from a region adjacent a first lateral edge of the collar portion. The elongated tab includes a plurality of teeth. A slot extends from a region adjacent a second lateral edge of the collar portion. The second lateral edge spaced from the first lateral edge by the collar portion. Each arm of the first plurality of separate arms includes a first end connectable in a socket of the collar portion and a second end connectable in a socket of the collar portion. Each arm of the first plurality of separate arms includes a first radius of curvature. Each arm of the second plurality of second arms includes a first end connectable in a socket of the collar portion and a second end connectable in a socket of the collar portion. Each arm of the second plurality of separate arms includes a second radius of curvature that is different than the first radius of curvature. The plurality of arms that form the centralizer are all arms selected from the first plurality of arms or all arms selected from the second plurality of arms. The number of selected centralizer arms being equal to twice the number of sockets in the collar portion of each retaining member. The first ends of the selected centralizer arms can be connected to respective sockets of the first retaining member and the second ends of the selected centralizer arms can be connected to respective sockets of the second retaining member. The first ends of the remaining centralizer arms can be connected to respective sockets of the third retaining member and the second ends of the selected centralizer arms can be connected to respective sockets of the fourth retaining member. The first centralizing member and the second centralizing member around the reinforcing member can be connected by a distance based on the diameter of the reinforcing member. The distance determined a number of teeth of the elongated tabs that are inserted in respective slots.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

Figure 1:
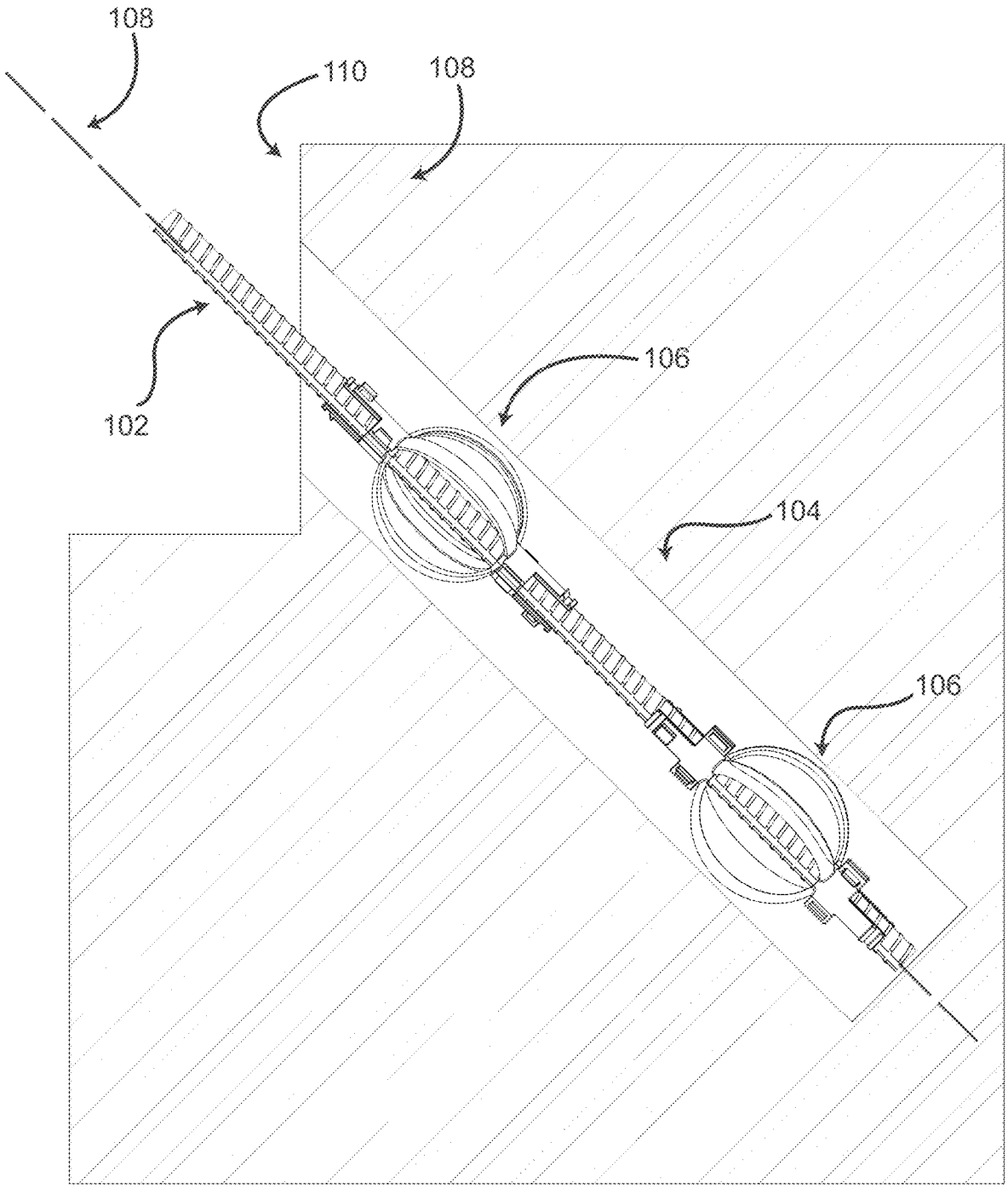
FIG. 1 illustrates a system for stabilizing the ground in accordance with some embodiments.

The following disclosure provides many different embodiments, or examples, for implementing different features of the invention. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

FIG. 1 shows an embodiment of a system 100 for centering a reinforcing member 102 inside a drilled shaft/bore hole 104 is presented. In some embodiments, the system 100 is used in conjunction with a construction technique known as soil nailing that is used to stabilize the surrounding ground. In other embodiments, the system can be used with a wellbore or any other hole or shaft.

As will be discussed in further detail below, a cage centralizer 106 is designed to keep the tendon/bar 102 (e.g., a reinforcing member or reinforcing bar) centered in the bore/drill hole 104 to allow for minimum grout/concrete coverage without impeding flow of the grout within the bore/drill hole 104 and around the tendon 102. The cage centralizer 106 can be made from a durable non-corrosive plastic and includes two identical halves that are easily snapped together without additional fasteners.

This centralizer can accommodate single bar, multi-bar/strand anchors, encapsulated (DCP) anchors, and steel or plastic pipe applications. In other words, each of these examples can be the tendon/bar 102. Particular embodiments envisioned are for soil nails, rocks/soil anchors, micro-piles, and auger-cast piles with single tension bars.

Figure 2:
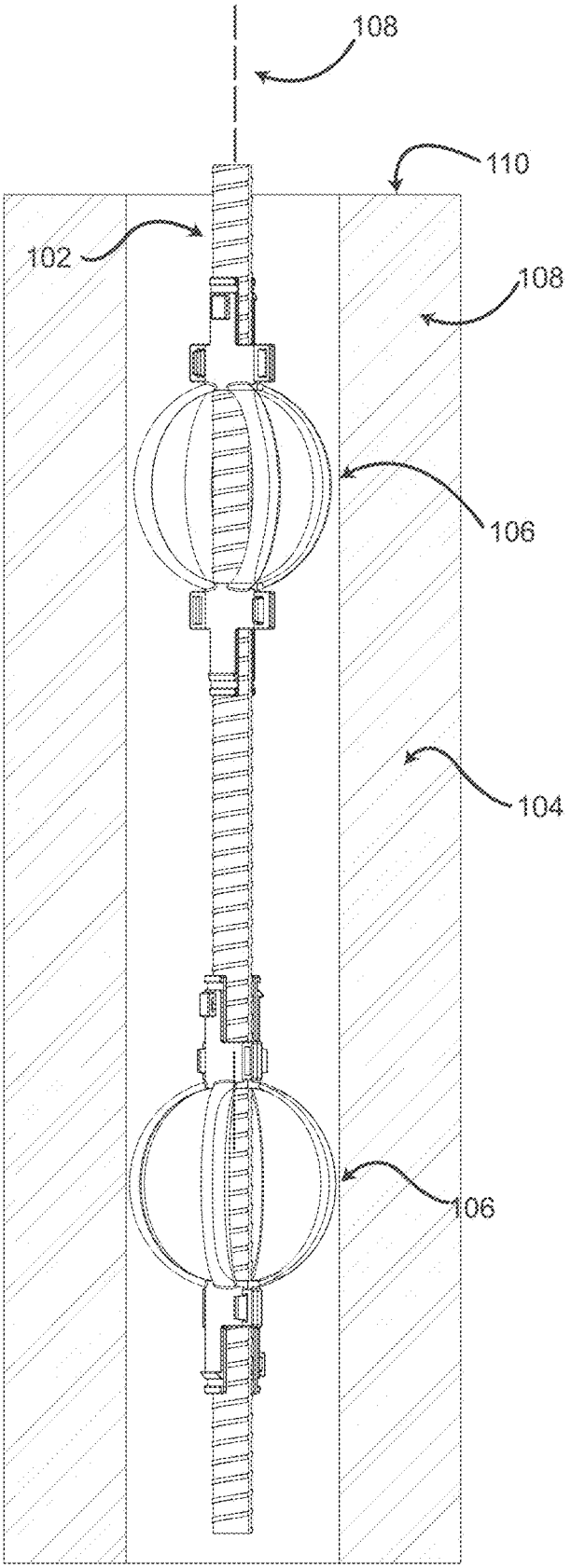
FIG. 2 illustrates another system for stabilizing the ground in accordance with some embodiments.

The drilled shaft/bore hole 104 is formed in the ground 108, e.g., soil, earth, dirt. The ground 108 may include a wall no, where the drilled shaft/bore hole 104 is drilled through the wall no. In some embodiments, the wall no is substantially vertical, as shown in FIG. 2. In other embodiments, the wall no may be sloped and may, for example, form an embankment. As such, the drilled shaft/bore hole 104 may be drilled vertically, horizontally, or at an angle. The term drilled/hole shaft refers to any hole or shaft in which is it desired to centralize a tendon/bar 102.

The reinforcing member 102 may be referred to as rebar, e.g., reinforcing steel or reinforcement steel. The member 102, however, is not necessarily made of steel. In some embodiments, the reinforcing member 102 may be high-strength steel bars, steel strand tendons, or the like. As is known, the outer surface of the reinforcing member 102 can be patterned to form a better bond with the concrete that will be injected in the drilled shaft/bore hole 104.

The system 100 includes one or more centralizing cages 106 that are positioned around the reinforcing member 102. The embodiment illustrated in FIGS. 1 and 2 show two centralizing cages 106. In some embodiments, the outer diameter of the centralizing cages 106 is slightly smaller than the diameter of the drilled shaft/bore hole 104. The centralizing cages 106 help to keep the reinforcing member 102 centered within the drilled shaft/bore hole 104. In an aspect, the centralizing cages 106 help to keep the reinforcing member 102 away from walls of the drilled shaft/bore hole 104 preferably positioned substantially along a central axis 109 of the drilled shaft/bore hole 104.

The centralizing cage 106 may be placed on the reinforcing member 102 at various locations on the reinforcing member 102. In one embodiment, a first centralizing cage may be placed at one end of the reinforcing member 102 and a second centralizing cage may be placed at a second, opposing end of the reinforcing member 102. Multiple centralizing cages 106 may be placed along the length of the reinforcing member 102 to help guide the reinforcing member 102 into the drilled shaft/bore hole 104 and keep the reinforcing member 102 centralized and away from the sidewalls of the drilled shaft/bore hole 104. The number of cages 106 will be determined by the application, e.g., the length of the reinforcing member 102.

The centralizing cage 106 can be attached to the reinforcing member 102 in any manner that keeps the centralizing cage 106 in position while the drilled shaft/bore hole 104 is being filled. For example, the centralizing cage 106 can be attached to the reinforcing member 102 using a zip tie, tie wrap (or tie wraps), wire, tape (e.g., duct tape), among other methods. Typically the centralizing cage 106 will be immobilized so that it cannot move up or down the reinforcing member 102 or rotate around the reinforcing member 102.

As noted above, FIG. 2 illustrates an embodiment where the reinforcing member 102 is inserted vertically into the hole/shaft 104. An example of a vertical reinforcement is an auger cast pile. Other examples are also possible.

Figure 3:
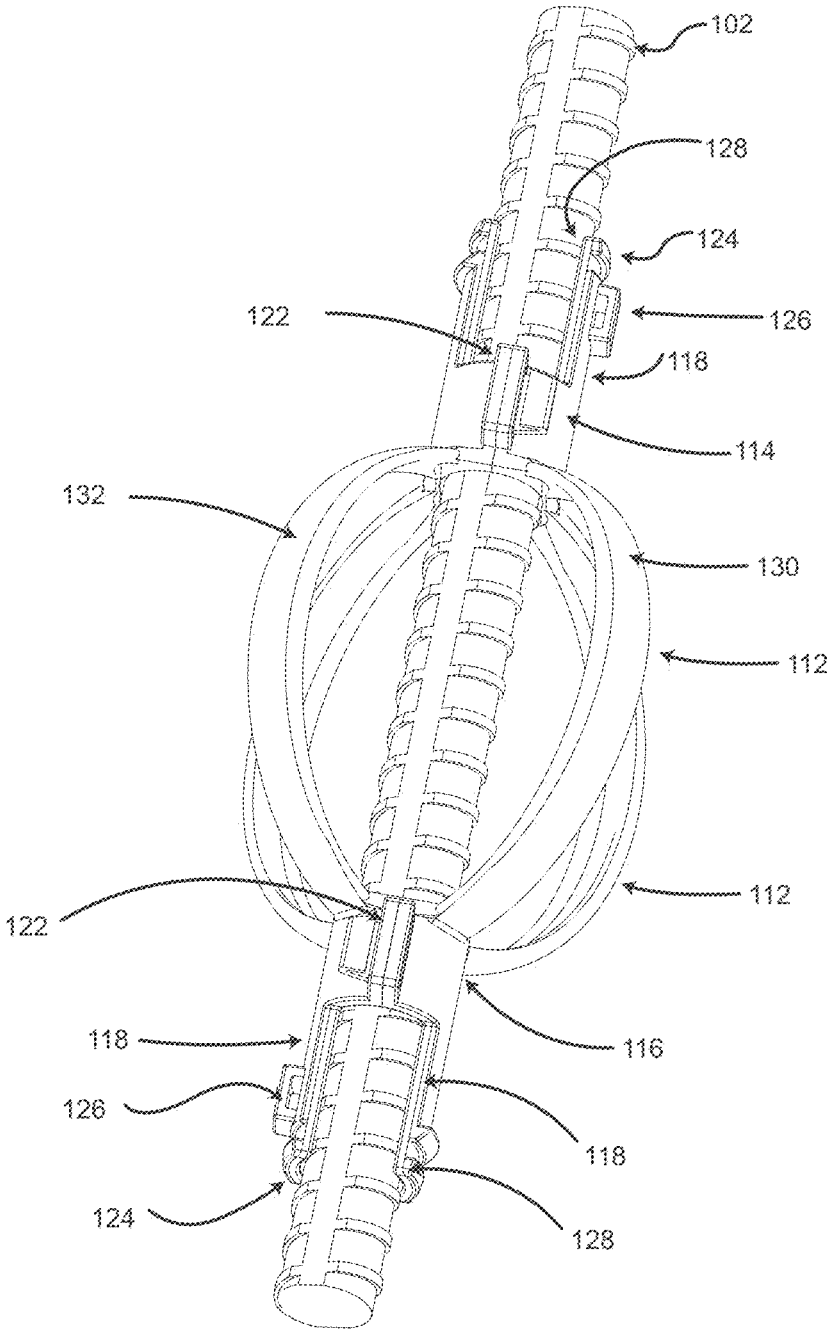
FIG. 3 is a perspective view of a centralizing cage surrounding a reinforcing member in accordance with some embodiments.
Figure 4A:
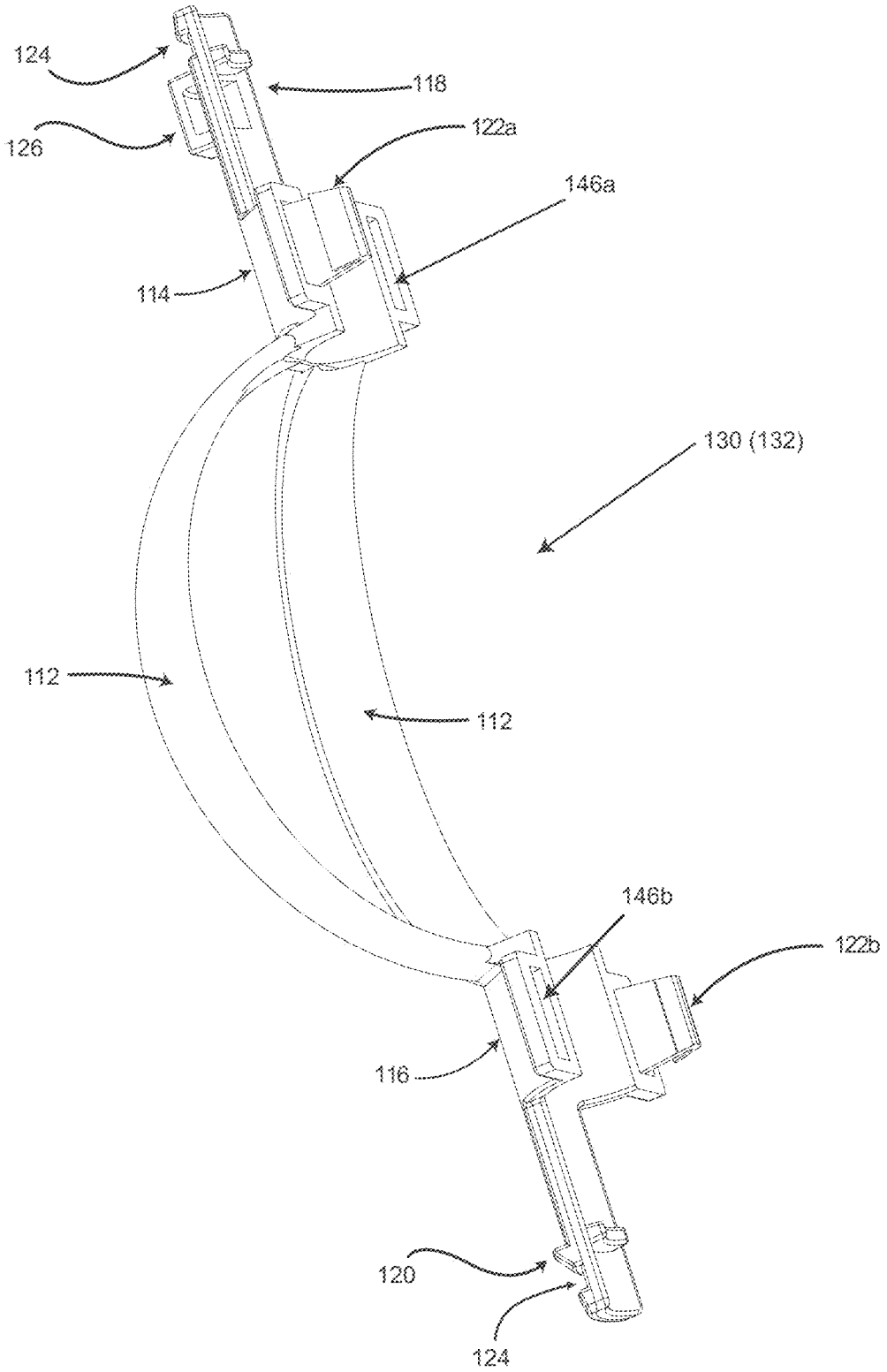
FIGS. 4A-4C, collectively referred to as FIG. 4, illustrate perspective views of a particular embodiment centralizing cage from different viewpoints.
Figure 4B:
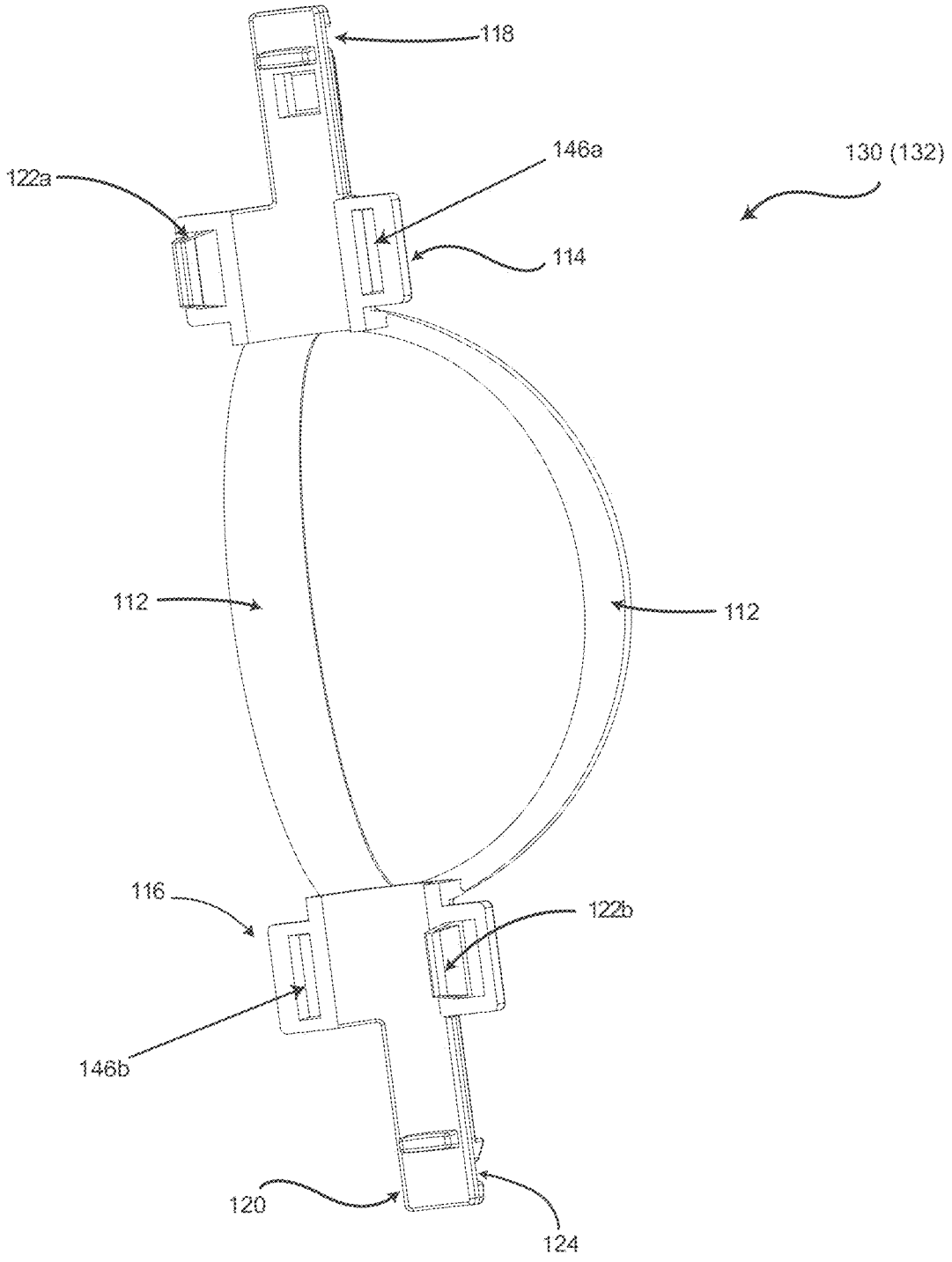
Figure 4C:
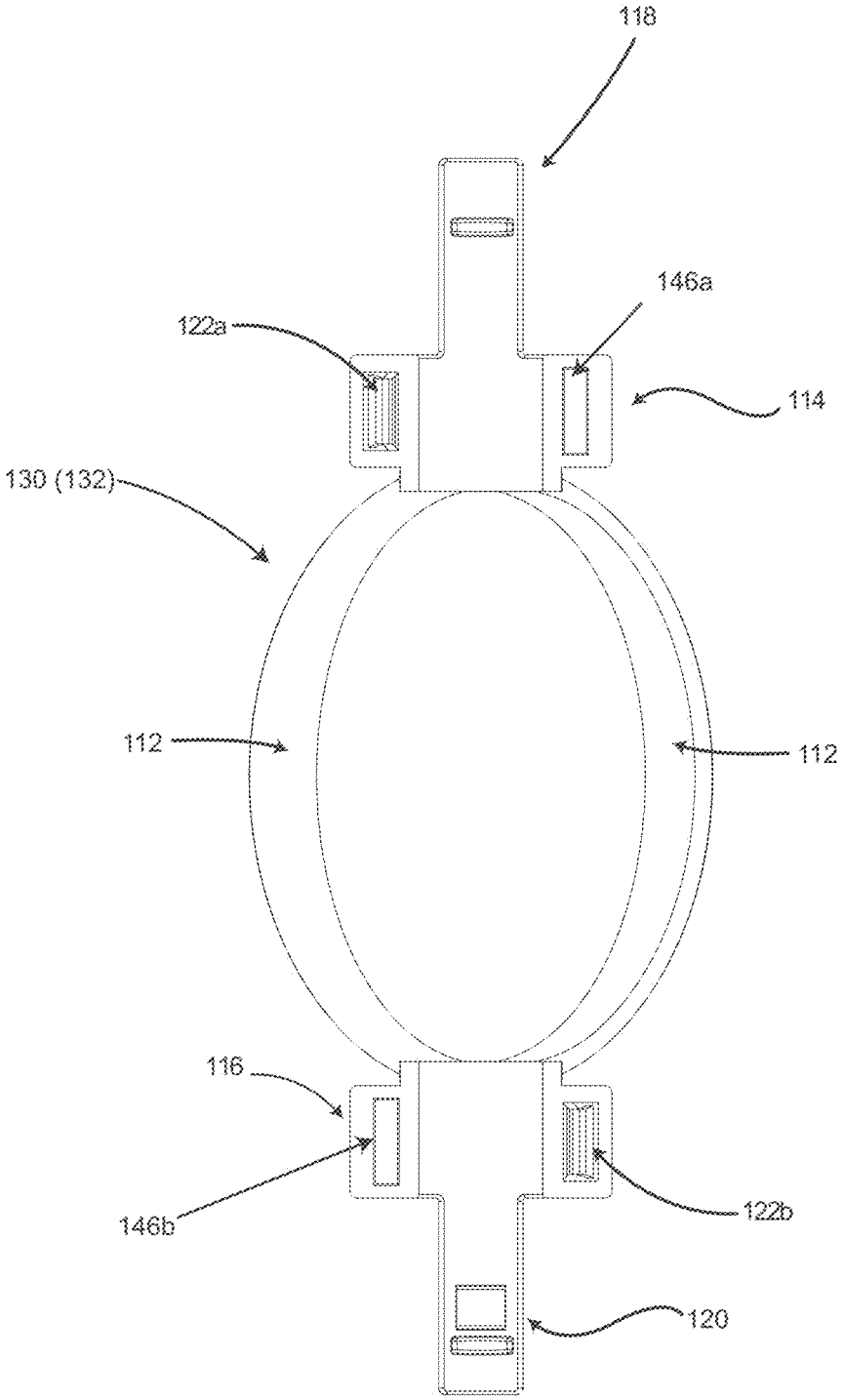

A first embodiment centralizing cage will now be described with respect to FIG. 3 and FIGS. 4A-4C (collectively "FIG. 4"). FIG. 3 shows a close-up, perspective view of a centralizing cage 106 surrounding the reinforcing member 102. The centralizing cage 106 is formed from two substantially identical pieces 130 and 132, referred to as cage members or halves. FIG. 4 shows three views of the cage members 130 (or 132).

The two pieces 130 and 132 surround the reinforcing member 102 when assembled as shown in FIG. 3. In its simplest configuration, the centralizing cage 106 includes a first neck portion 118, a first collar portion 114, a plurality of arm portions 112, a second collar portion 116, and a second neck portion 120. The first and second collar portions 114, 116 form first and second semi-annular shoulders when connected together. The first and second neck portion portions 118 and 120, the first and second collar portions 114 and 116 and the arm portions 112 are formed as a single integral member.

Each of the cage members 130 (132) will now be described with respect to FIGS. 4A-4C, in conjunction with FIG. 3. Since the cage members are substantially identical, the illustrated cage member can be either a first half 130 or a second half 132. This feature provides advantages in procurement and in the field since the cage members are interchangeable. Also, because the cage is formed in two pieces, transport and storage are simplified.

The first and second collar portions 114, 116 both include a set of flanges to assist with attachment. In this example, the first collar portion 114 includes a locking member that is formed from a tab 122*a* and a corresponding slot 146*a*. Similarly, second collar portion 116 includes a locking member that is formed from a tab 122*b* and a corresponding slot 146*b*. The locking members are provided to fasten the two halves of the centralizing cage 106 together. The first and second collar portions 114, 116 are formed symmetrically so that the cage member can be interlocked with a substantially identical cage member so as to form a centralizing cage 106.

The first collar portion 114 includes a first tab and a first slot and the second collar portion 116 includes a second tab and a second slot. The first tab is configured to join with a second slot of the substantially identical cage member; the first slot is configured to receive a second tab of the substantially identical cage member; the second tab is configured to join with a first slot of the substantially identical cage member; and the second slot is configured to receive a first tab of the substantially identical cage member. In this example, the slots and tabs 122 and 146 are arranged on opposite sides so that when to cage members 130 and 132 are brought together, the tab 122*a* will fit within the slot 146*b* and similarly the tab 122*b* will fit within the slot 146*a*.

In some embodiments, the identical halves 130, 132 are removably connected to each other. In alternative embodiments, the identical halves 130, 132 are permanently connected to each other. In a preferred embodiment, the cage member is designed to be permanently interlocked with the substantially identical cage member so as to form the centralizing cage.

Each cage member 130 (132) includes a plurality of arm portions 112 extending between the collar portions 114 and 116. In the illustrated example, each cage member includes two arm portions 112 so that the assembled cage will include four arm portions 112. Each of the arm portions extends away from a central axis of the centralizing cage 106. In the typical embodiment, the structure is built so that the central access will be aligned with a central axis of the reinforcing member 102, which is in turn aligned with the central axis 109 of the drilled shaft/bore hole 104. The arm portions 112 will extend equal distances away from the common central axis.

As illustrated in the figures, the arm portions 112 can have a curved shape with the peak being at a point central between the first collar portion 114 and the second collar portion 116. In other examples, the arm portions 112 can include segments that are joined at various angles. The arm portions 112 are spaced equally along the circumference of a circle with a center point that intersects the central axis. It is noted, however, that these preferred configurations are not a requirement. In the typical implementation, the reinforcing member 102 will be centered within the drilled shaft/bore hole 104. Other embodiments are also envisioned.

A first neck portion 118 extends from the first collar portion 114 and a second neck portion 120 extends from the second collar portion 116. The first and second neck portions 118, 120 are shaped such that the inner surface of the first and second neck portion 118, 120 fit around the outer diameter of the reinforcing member 102. Since the reinforcing member is typically a cylindrical bar, the first and second neck portions 118, 120 have a substantially curved or annular shape such that the inner surface of the first and second neck portion 118, 120 curves at least partially around the outer diameter of the reinforcing member 102. Other shapes could also be used.

Both the first neck portion 118 and the second neck portion 120 can be designed to facilitate a tie or other fastener that is used to attach the assembled centralizing cage 106 two a reinforcing member 102. In the illustrated example, the first and second neck portions 118, 120 each have a channel or groove 124 formed therein on an outer surface. The second neck portion 120, in some embodiments, includes an enclosure 126 with an aperture formed therein.

Extending from the inner surface of the first and second neck portion 118, 120 is a protrusion 128. The protrusion 128 is operable to engage the outer surface of the reinforcing member 102 to help prevent slippage of the centralizing cage 106 distally along the length of the reinforcing member 102.

Figure 5:
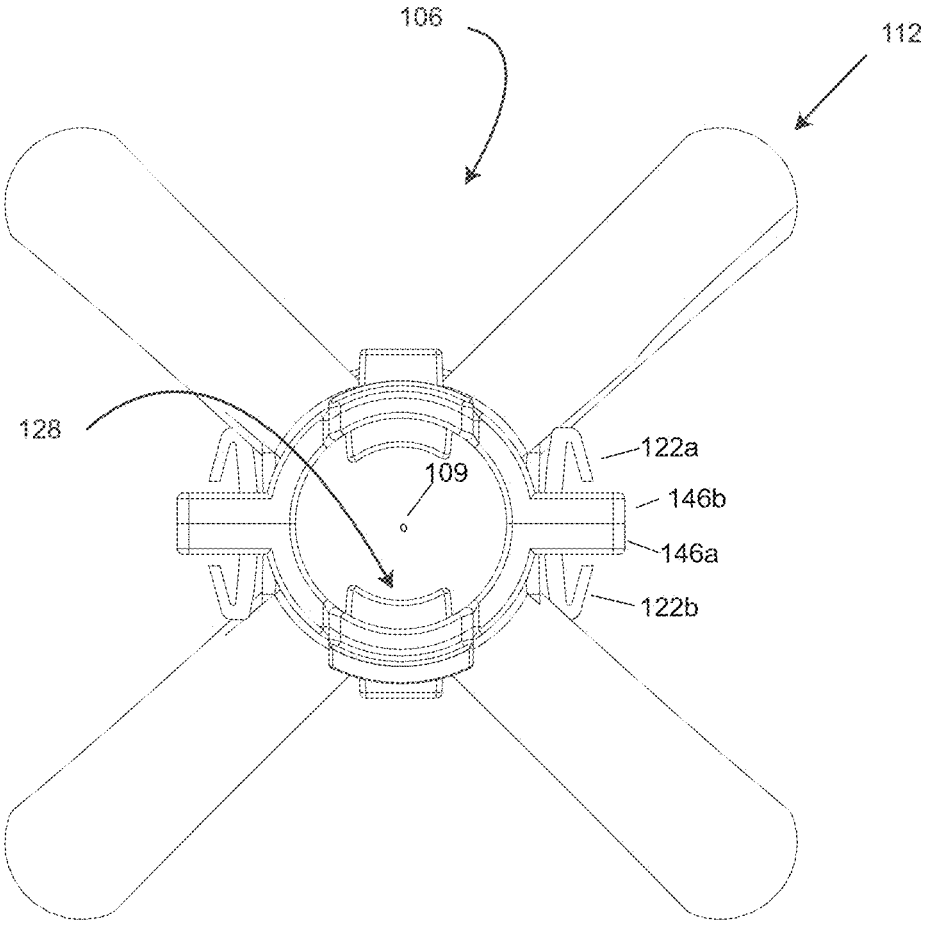
FIG. 5 is a top view of the centralizing member of FIG. 4 in accordance with some embodiments.

FIG. 5 shows a view of an assembled centralizing cage 106 as viewed along the central axis 109 of the cage and, in the typical case, of the reinforcing bar 102 and the drilled shaft/bore hole 104. As shown here, the arm portions 112 extending radially away from the central axis 109. The four arm portions in this example are equally spaced 90° apart from each other.

This view also shows the tabs 122 interconnected with the slots 146. As shown, the tab 122 of one of the two halves is interlocked with the slot 146 of the other of the two halves. It is understood that, while they appear to be aligned looking into and out of the page, the two pairs of slots and tabs are actually spaced along the central axis 109. Also pointed out in the figure is the protrusion 128, which can be used to prevent slippage along the reinforcing member 102.

Figure 6A:
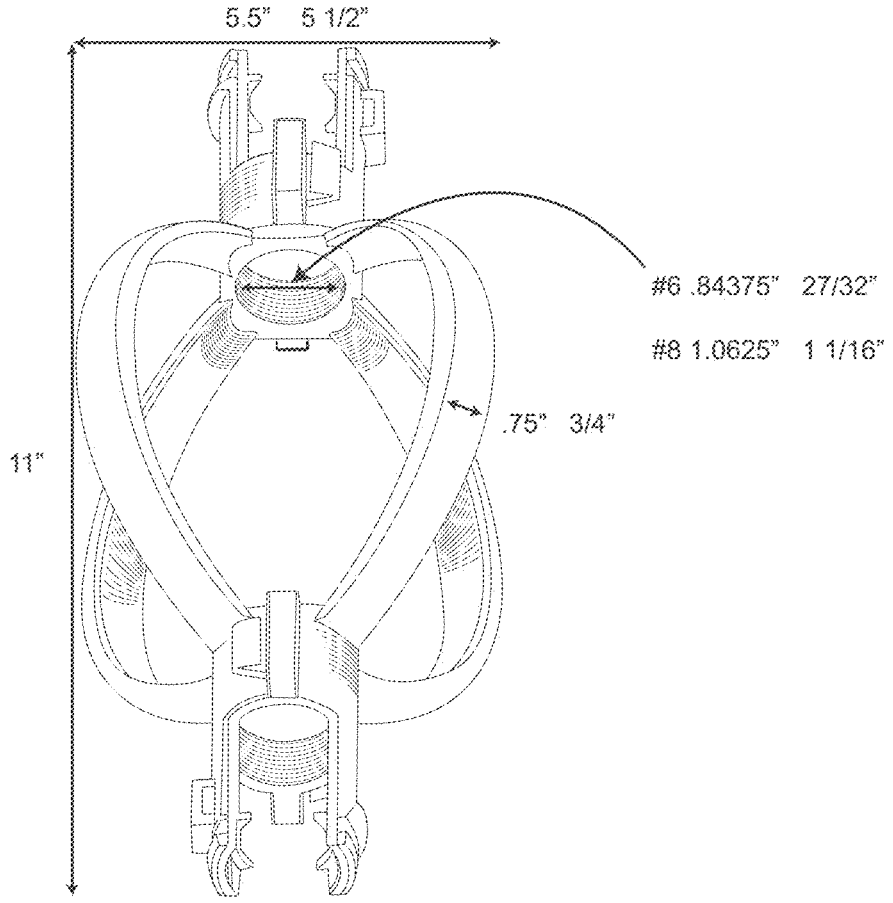
FIGS. 6A-6C, collectively referred to as FIG. 6, show views of various sized centralizing cages in accordance with some embodiments.
Figure 6B:
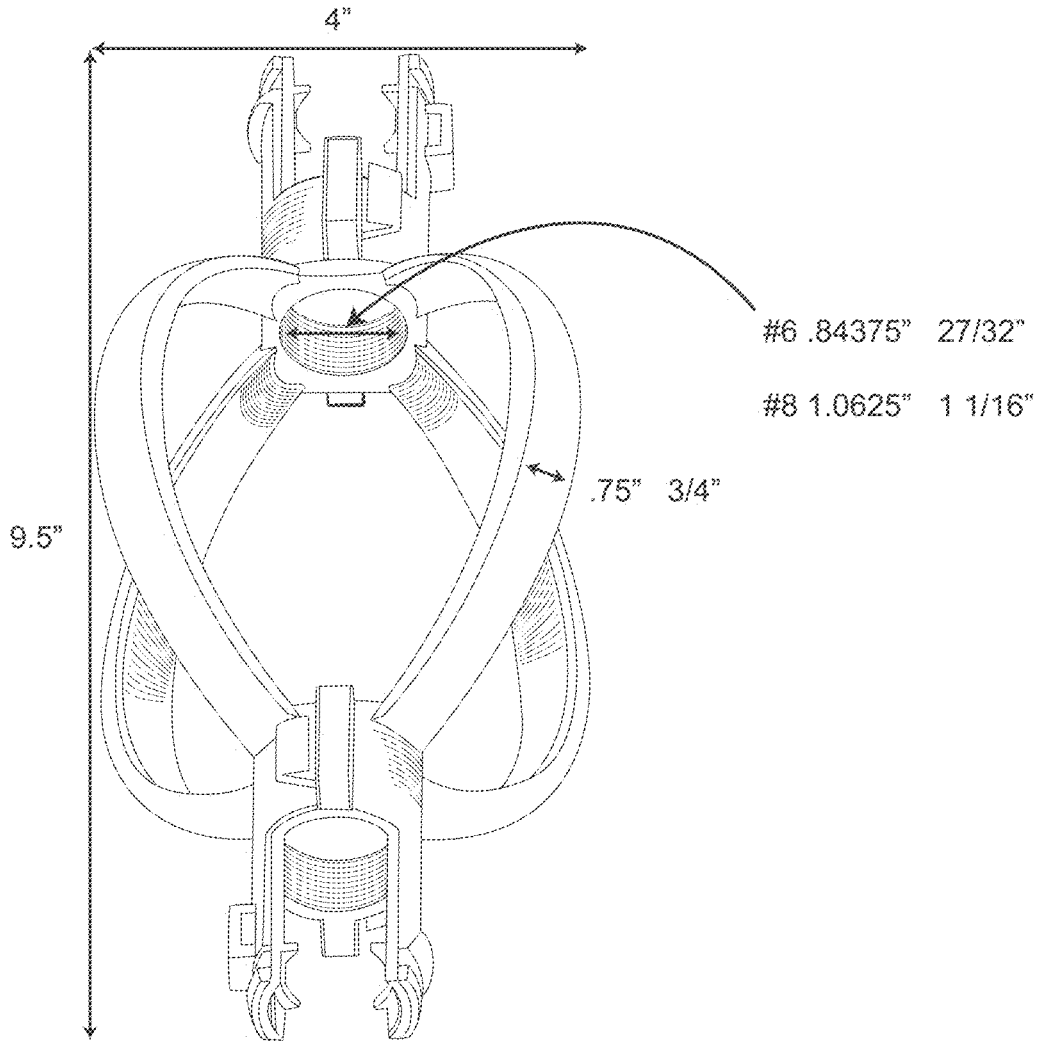
Figure 6C:
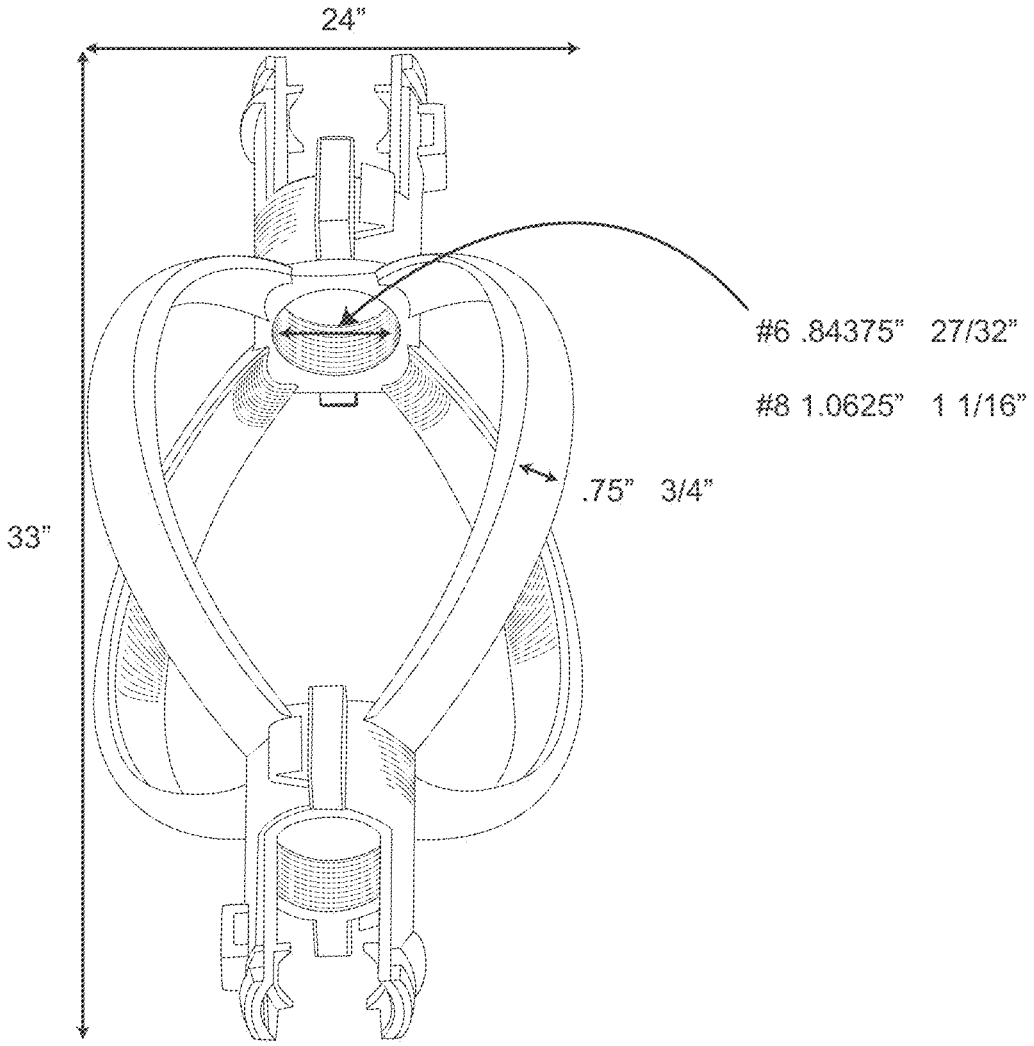

FIGS. 6A-6C are provided to show that the centralizing cage 106 can be formed in any number of dimensions. Three specific examples are provided here.

In the example of FIG. 6A, this particular cage has a length that is twice the width, 11 inches by 5.5 inches in this case. This cage can be used, for example, in a six inch bore hole (or any other drilled shaft/bore hole that is larger than 5.5 inches). The specific dimensions illustrated here can be modified depending upon the design, e.g., could be scaled proportionately.

The centralizing cage 106 of the present invention can be used with various dimensioned rebar. For example, the collar portions have a diameter of 0.8475 inches to fit around tendon/rebar sizes #5 through #6 or can have a diameter of 1.0625 inches to fit around tendon/rebar sizes #7 through #8.

In general, the centralizing cage 106 can be sized in any dimension, based on the size of the drilled shaft/bore hole and the tendon/rebar. For example, it is envisioned that a centralizing cage 106 can be sized to fit a drilled shaft/bore hole of 4 inches (or even smaller) up to 24 inches or larger. It can be sized to operate with a rebar/tendon from #8 to #24, as examples.

Figure 7A:
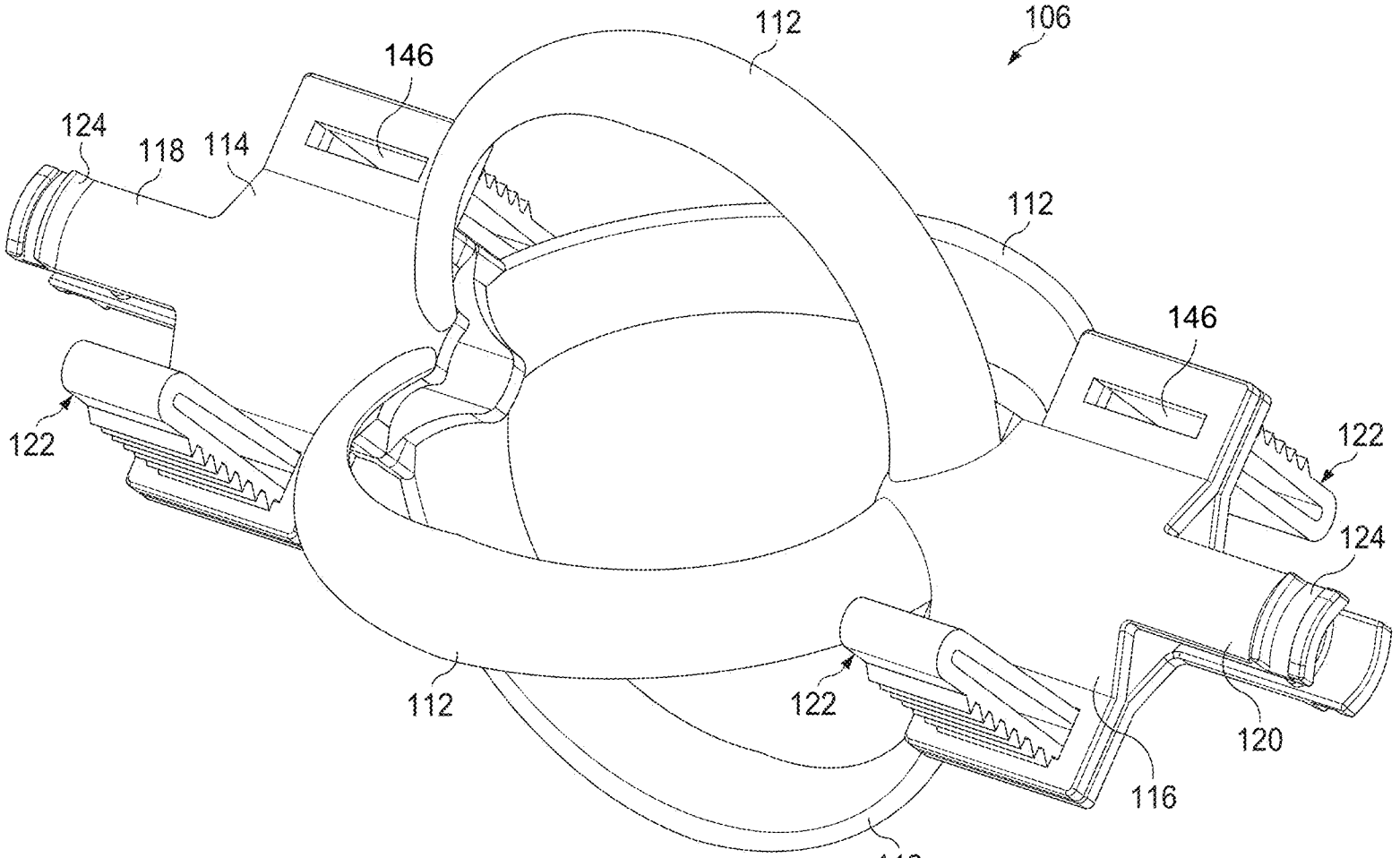
FIGS. 7A-7B, collectively referred to as FIG. 7, show perspective views of a centralizing cage in accordance with further embodiments.
Figure 7B:
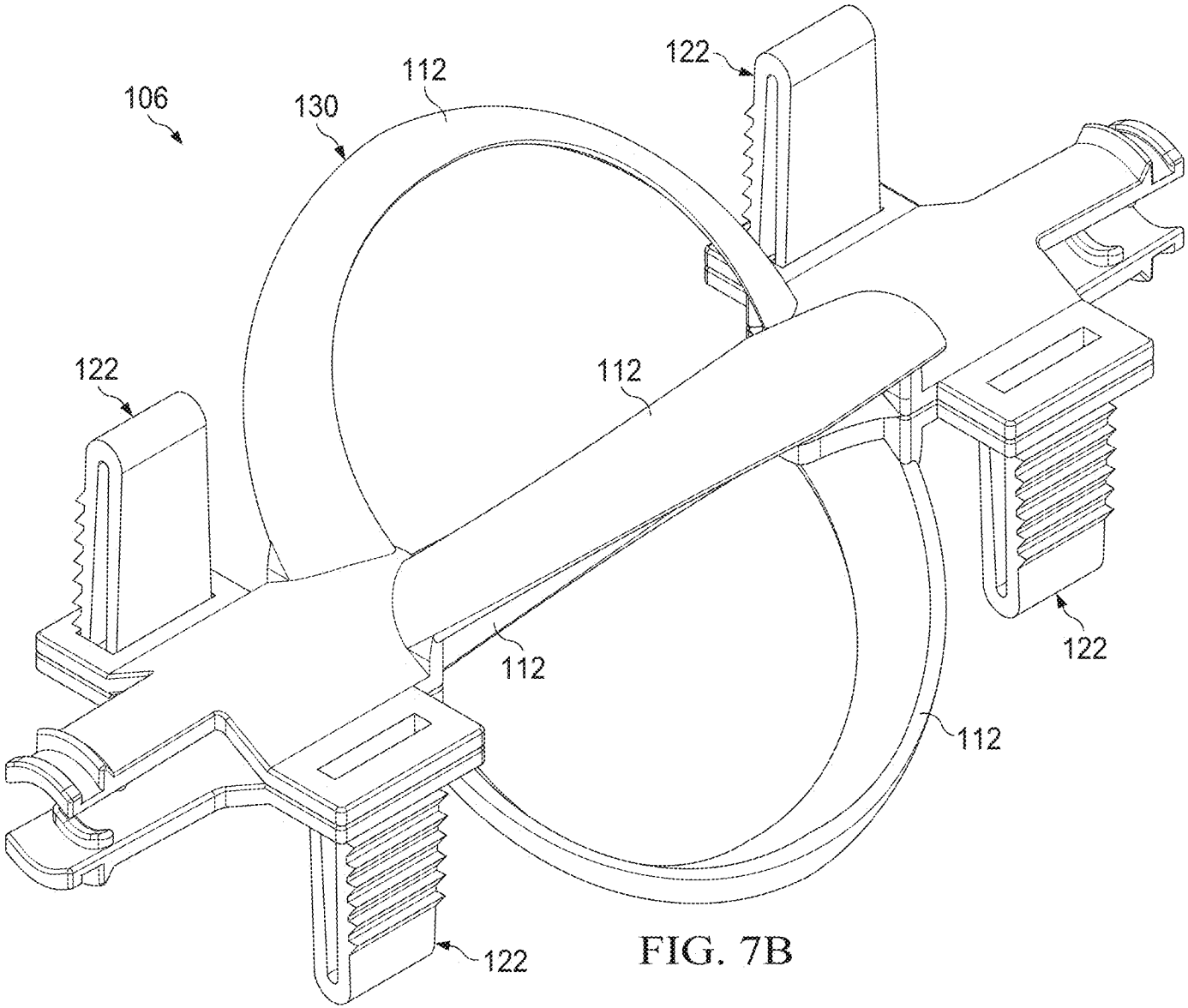

FIG. 7, which includes FIGS. 7A and 7B, shows a second embodiment centralizing cage 106. This cage is similar to the centralizing cage 106 described with respect to FIG. 3 and, as such, common aspects will not be described again. It is understood that variation shown in each of the embodiments can be interchanged. A single cage member 130, i.e., one of the two cage members forming the centralizing cage 106 is shown in FIG. 8.

In the embodiment of FIG. 7, the tabs 122 are elongated and include a plurality of teeth so that the effective diameter of the centralizing cage 106 is adjustable. In other words, two identical centralizing cages can be attached to form centralizing cages of various sizes. This flexibility provides a number of advantages in manufacture and inventory control since fewer unique parts needs to be fabricated.

Figure 8A:
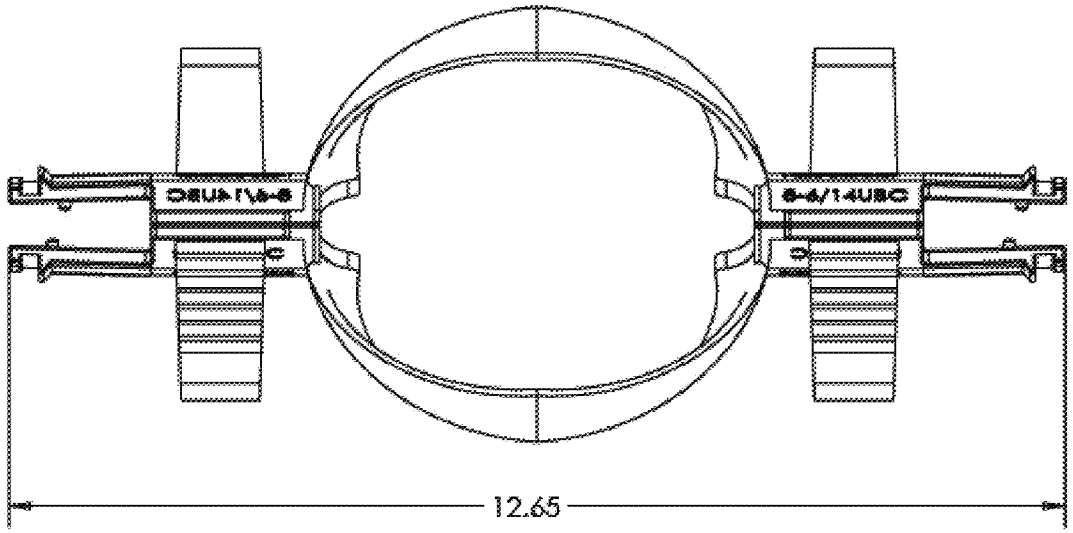
FIGS. 8A-8B, collectively referred to as FIG. 8, show a particular embodiment centralizing cage.
Figure 8B:
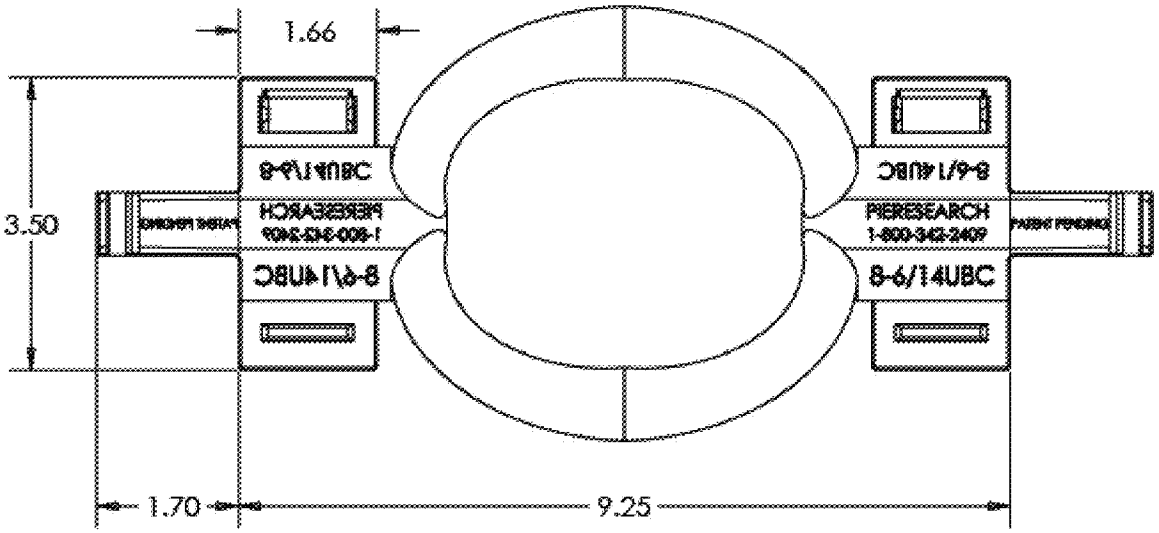

FIG. 8, which includes FIGS. 8A-8C, is provided to show dimensions of one specific example of the embodiment of FIG. 7. As discussed above with respect to FIG. 6, the centralizing cage 106 can be sized in any dimension, based on the size of the drilled shaft/bore hole and the tendon/rebar. For example, it is envisioned that a centralizing cage 106 can be sized to fit a drilled shaft/bore hole of 4 inches (or even smaller) up to 24 inches or larger.

It can be sized to operate with a rebar/tendon from #8 to #24, as examples. Advantageously, a single centralizing cage of the embodiment of FIG. 7 can be used with various sized shaft/bore holes and tendon/rebars.

Figure 9B:
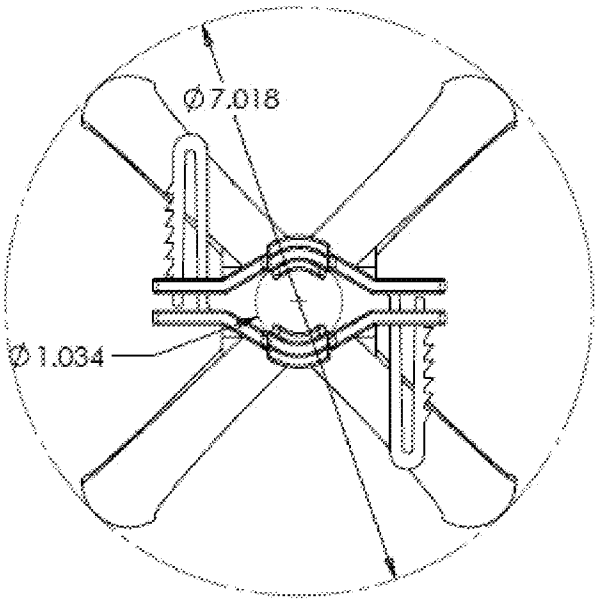
FIGS. 9A-9G, collectively referred to as FIG. 9, show how a single centralizing cage can be adjusted to fit a number of applications.
Figure 9A:
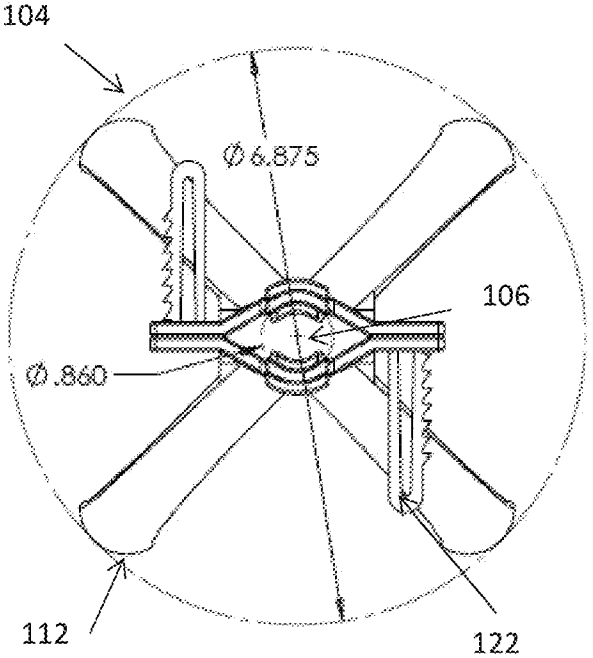
Figure 9D:
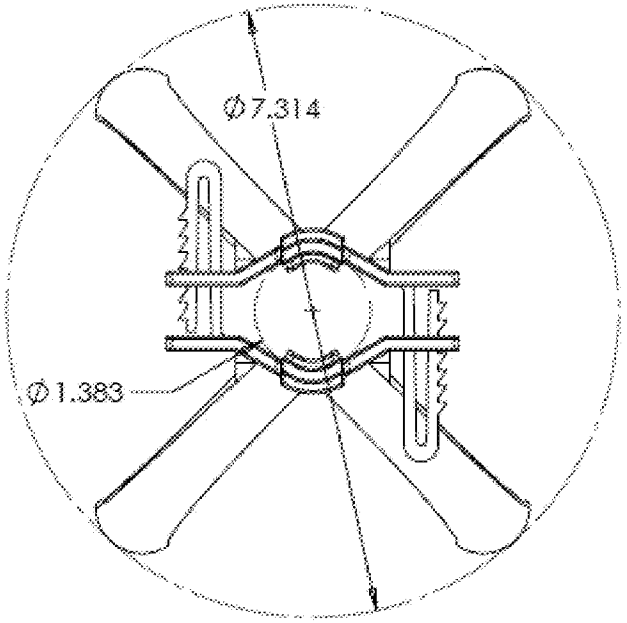
Figure 9C:
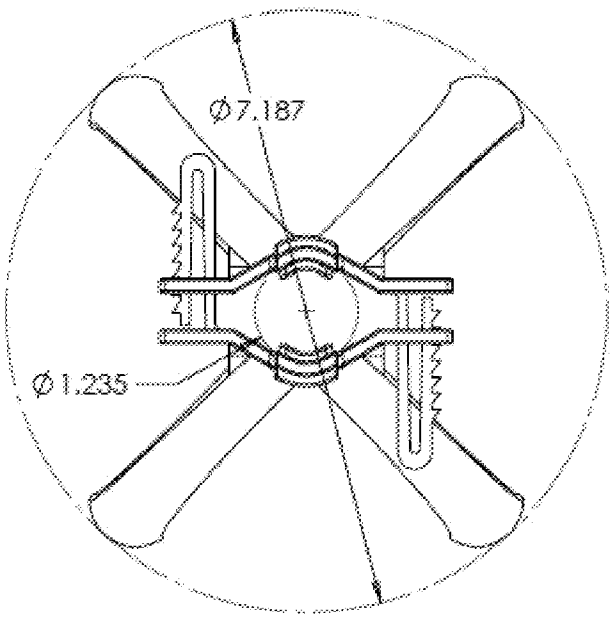
Figure 9F:
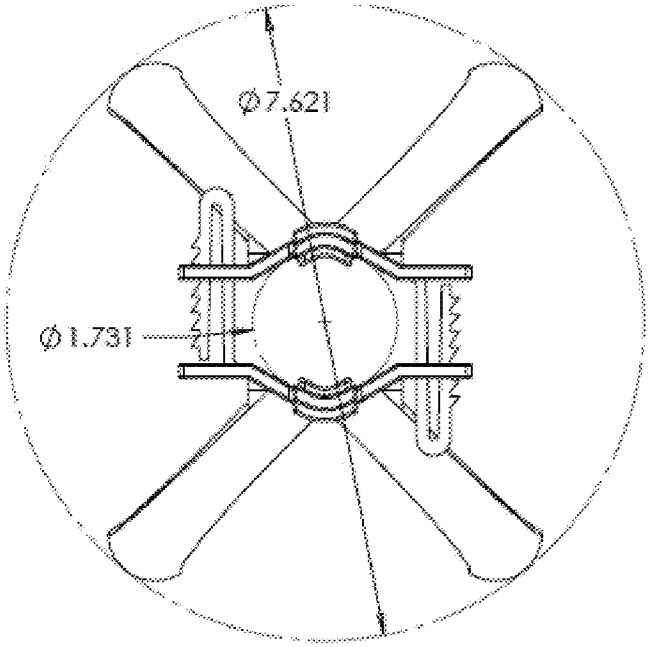
Figure 9E:
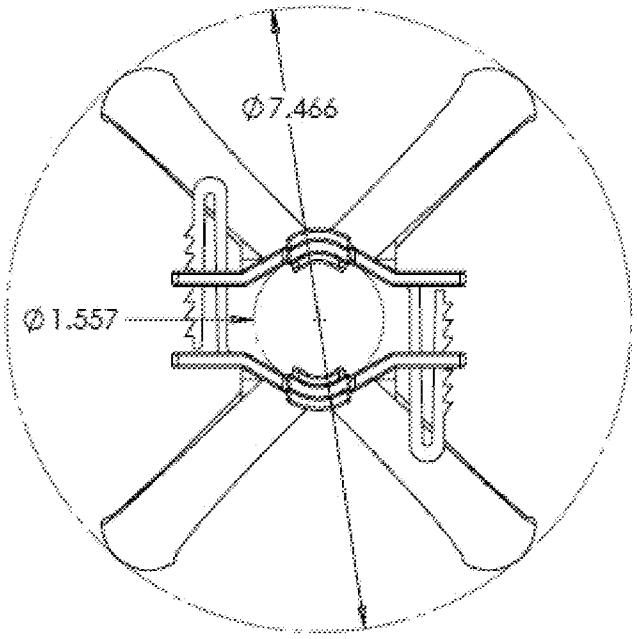
Figure 9G:
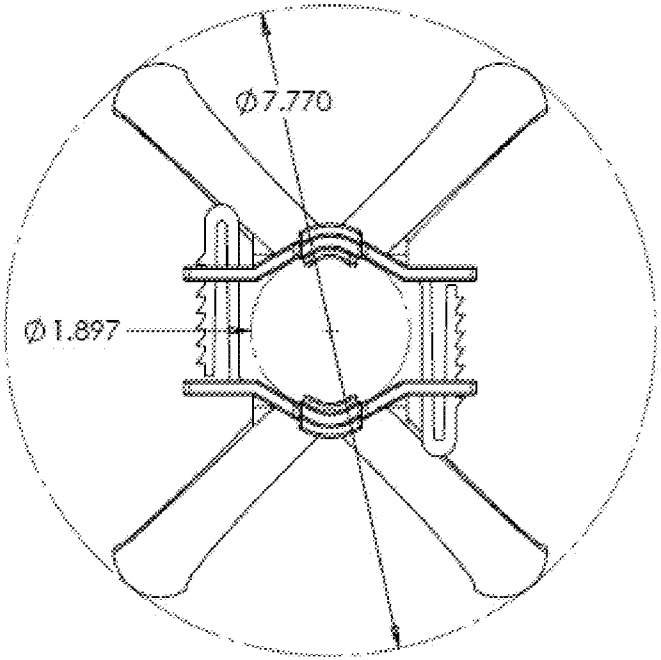

FIGS. 9A-9G (collectively FIG. 9) illustrate various size cages 106 that can be formed from the same size cage members 130. For example, FIG. 9A shows a centralizing cage with an outer diameter of 6.875 inches while FIG. 9G shows a centralizing cage with an outer diameter of 7.77 inches. The other figures show sizes between these two extremes.

It is noted that specific sizes shown in FIG. 9 merely provide examples. It is understood that other sizes could be designed to accommodate different diameters holes and different diameter bar/tendon.

Figure 10A:
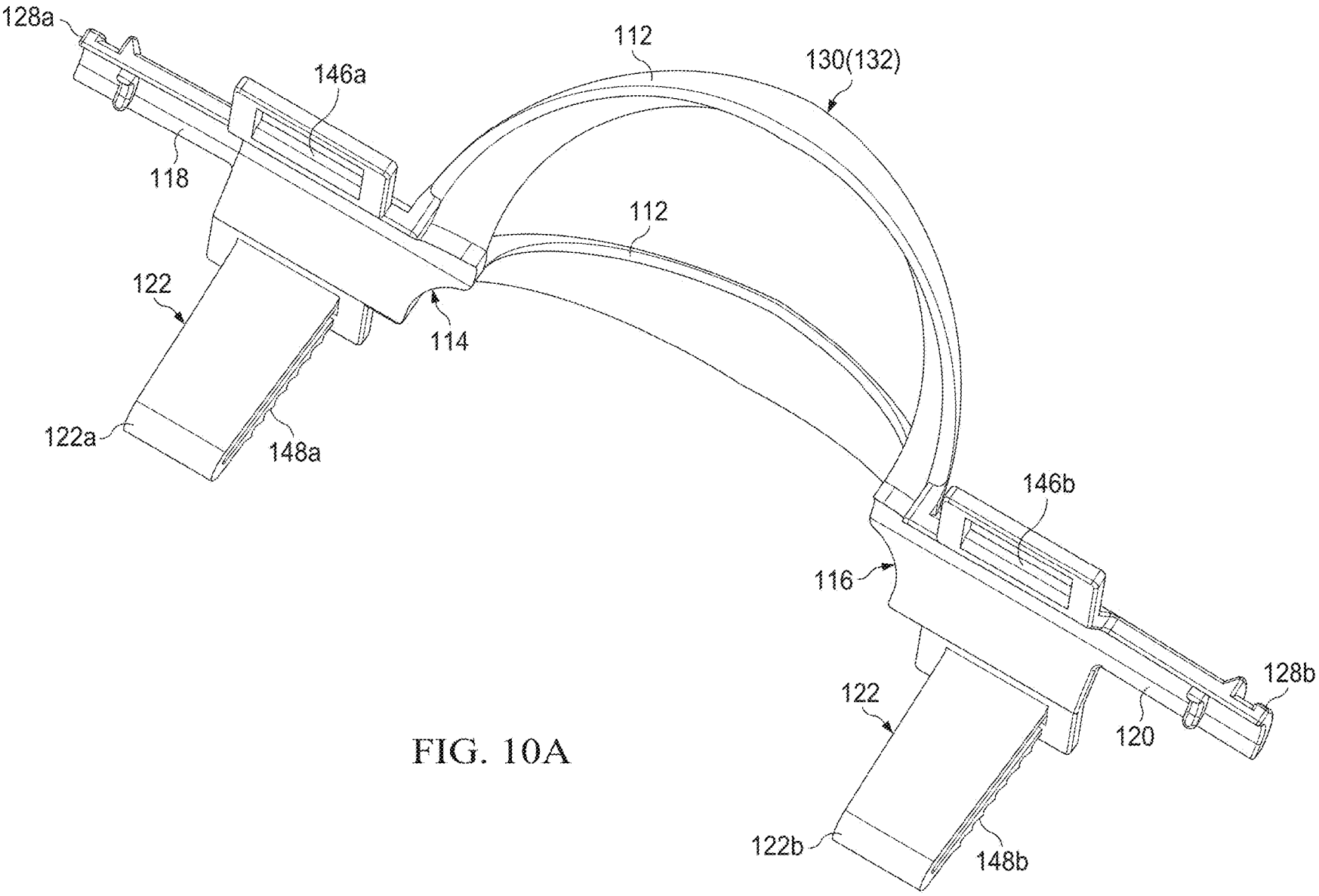
FIGS. 10A-10C, collectively referred to as FIG. 10, show perspective views of a an embodiment centralizing cage member from different viewpoints
Figure 10B:
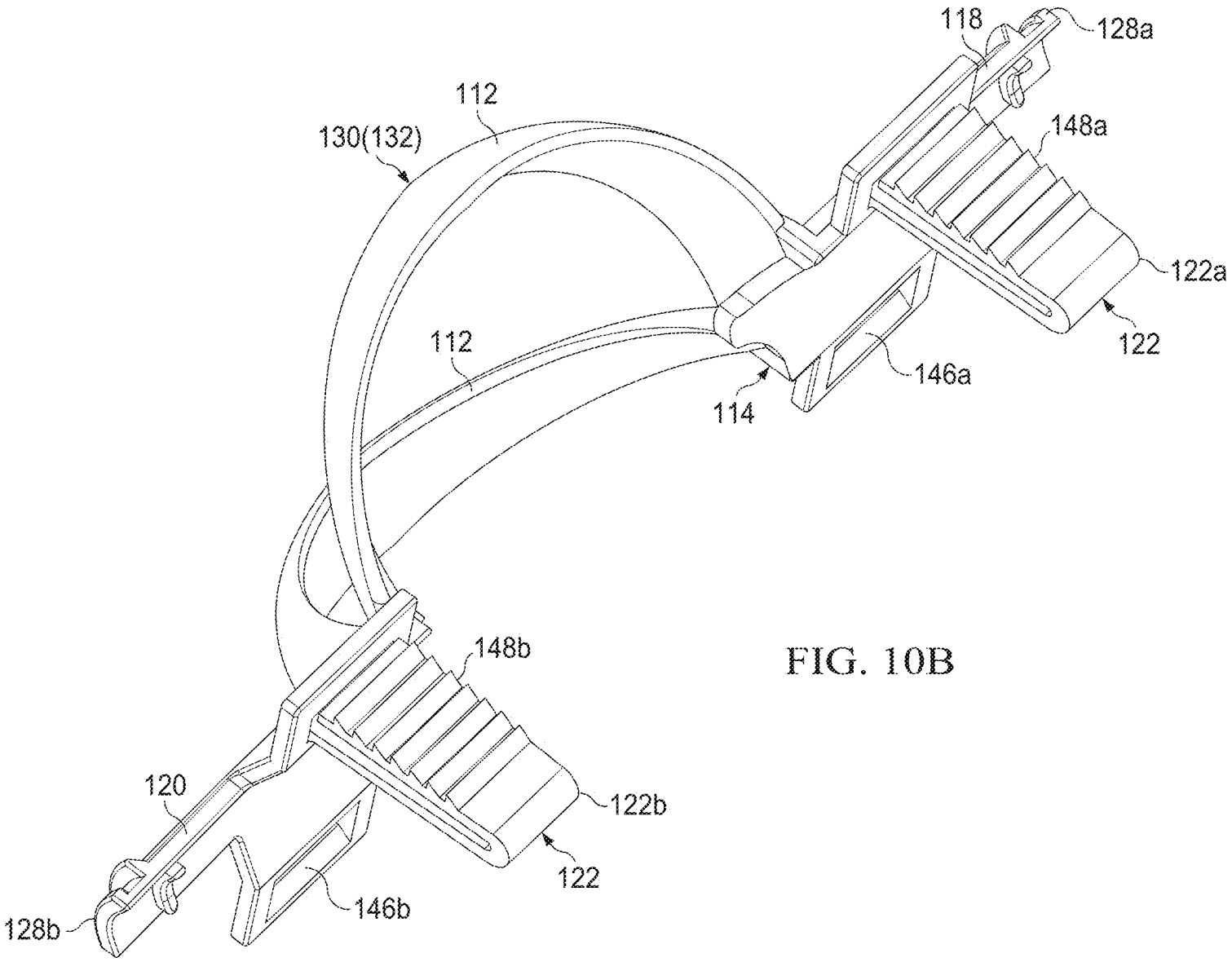
Figure 10C:
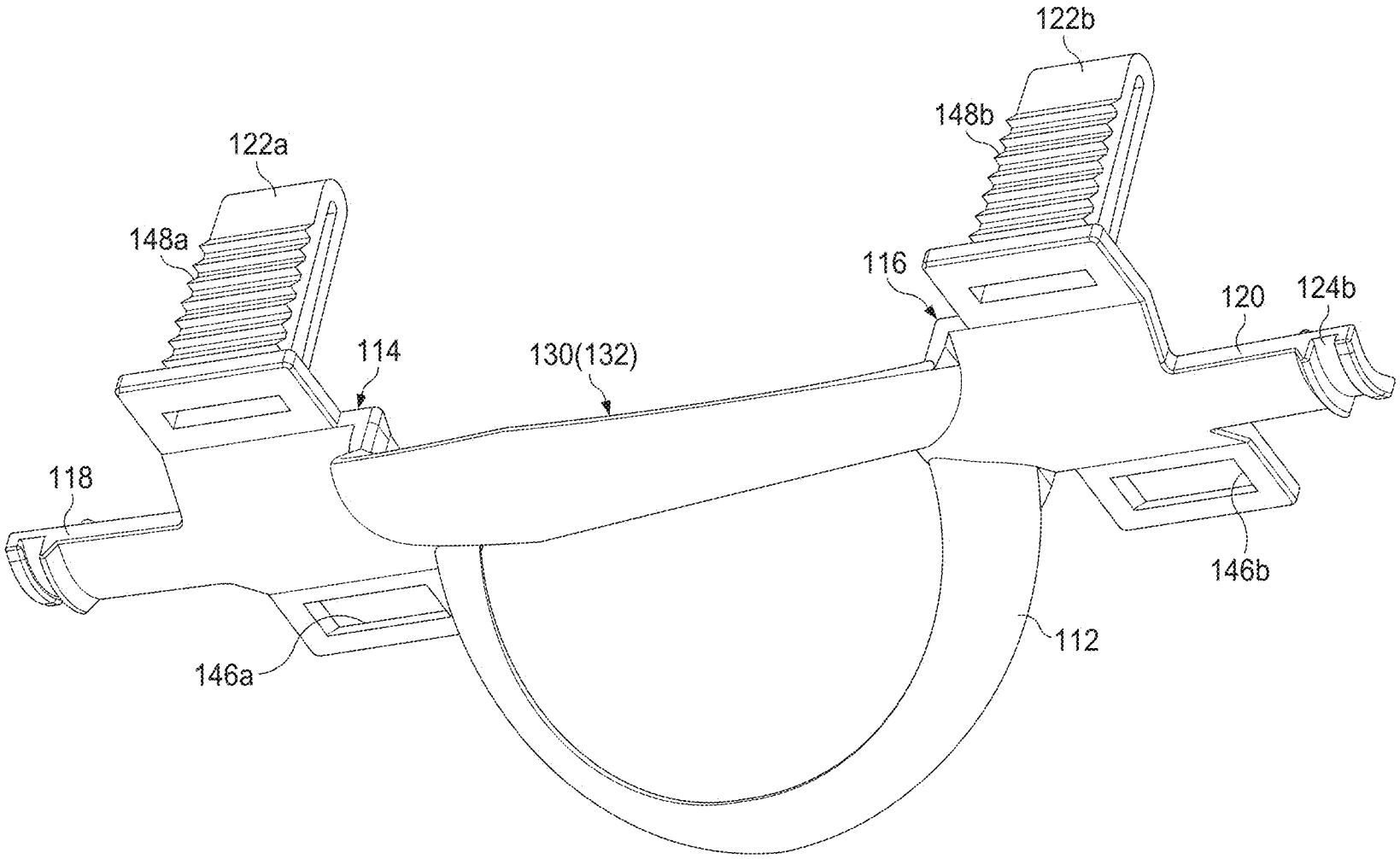

FIGS. 10A-10C show different perspective views of one of the two centralizing cage members 130 (or 132) that are combined to form the centralizing cage. Since the cage members are substantially identical, the illustrated cage member can be either a first half 130 or a second half 132. While the different views show a single embodiment, it is understood that variations are within the scope of the invention.

As above, the cage member 130 is a single member with a plurality of portions, including, a first neck portion 118 and a second neck portion 120 spaced from the first neck portion 118 along a central axis 109. A first collar portion 114 is adjacent the first neck portion 118 and a second collar portion 116 is adjacent the second neck portion 120. A first elongated tab 122*a* extends from a region adjacent a first lateral edge of the first collar portion 114 and includes a plurality of teeth 148*a*.

A first slot 146*a* extends from a region adjacent a second lateral edge of the first collar portion 114. As shown in the figure, the second lateral edge is spaced from the first lateral edge by the first collar portion 114. A second elongated tab 122*b* extends from a region adjacent a first lateral edge of the second collar portion 16 and includes a plurality of teeth 148*b*. A second slot 146*b* extends from a region adjacent a second lateral edge of the second collar portion 116. As before, the second lateral edge spaced from the first lateral edge by the second collar portion 116.

A plurality of arm portions 112 extend from the first collar portion 114 to the second collar portion 116. The first and second neck portions 118 and 120, the first and second collar portions 114 and 116, the first and second tabs 122*a* and 122*b*, the first and second slots 146*a* and 146*b*, and the arm portions 112 of the cage member 130 are the portions of the single member. This single member can be an injection molded member.

As with the first embodiment, the first and second collar portions 114 and 116 are formed symmetrically so that the cage member 130 can be interlocked with a substantially identical cage member 132 so as to form a centralizing cage 106. In this example, the first elongated tab 122*a* is configured to join with the second slot 146*b* of the substantially identical cage member, the first slot 146*a* is configured to receive the second elongated tab 122*b*, of the substantially identical cage member, the second elongated tab 122*b* is configured to join with the first slot 146*a* of the substantially identical cage member, and the second slot 146*b* is configured to receive a first elongated tab 122*a* of the substantially identical cage member.

The first elongated tab 122*a* and the second slot 146*b* can be arranged on the left side of a line extending perpendicular to the central axis 109 of the cage member 130, the line being midway between the first and second neck portions 118 and 120. The second elongated tab 122*b* and the first slot 146 can be arranged on the right side of the perpendicular to the central axis 109 of the cage member 106. The cage member 130 described with respect to this figure is designed to be permanently interlocked with the substantially identical cage member 132 so as to form the centralizing cage 106.

In the embodiment of FIG. 4, the tab 122*a* and the slot 146*b* are one side of the central axis while the tab 122*b* and the slot 146*a* are on the opposite side. In the embodiment of FIG. 10, on the other hand, the tab 122*a* and the slot 146*ab* are one side of the central axis while the tab 122*a* and the slot 146*b* are on the opposite side. Either configuration can be used with either embodiment.

In one example, a first channel is formed in an outer surface of the first neck portion 118 and a second channel is formed in an outer surface of the second neck portion 120. A protrusion 128 can extend from an inner surface of the first neck portion and a second protrusion 128 extends from an inner surface of the second neck portion. The protrusion 128 can be used to help prevent the centralizing cage 106 from moving along the tendon/bar 102 and is separate from the tabs 122.

The cage member 130 is configured so that upon connection with an identical cage member 132 a diameter of an enclosure formed by the first and second channels of the cage member 130 and the identical cage member 132 is variable depending upon the connection of the elongated tabs and slots, in other words, depending upon how many teeth 148 extend through the slot 146.

Other features discussed above can be incorporated in this embodiment and vice versa.

Figure 11:
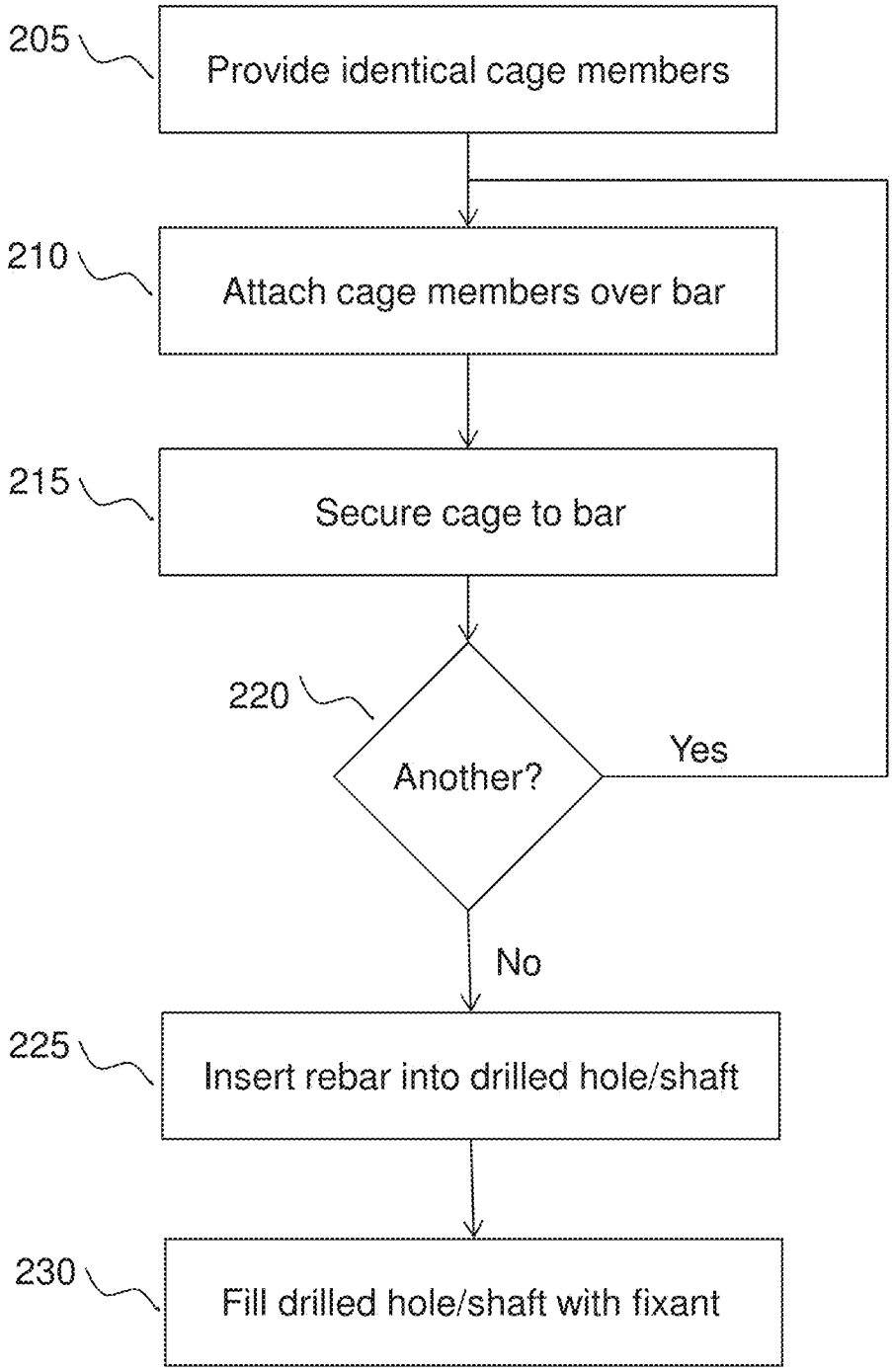
FIG. 11 is a flowchart summarizing steps in utilizing the centralizer.

FIG. 11 provides a flow chart illustrating a method of using the centralizing cage 106 of any of the embodiments discussed herein. This example provides a method for centering a reinforcing bar 102 within a drilled shaft/bore hole 104. A number of substantially identical cage members are provided as shown in step 205. These members may be as described above. For example, each centralizing cage member includes a first neck portion, a second neck portion spaced from the first neck portion along a central axis, a first semi-annular shoulder adjacent the first neck portion, a second semi-annular shoulder adjacent the second neck portion, and a plurality of arm portions extending from the first neck portion to the second neck portion. The first and second neck portions, the first and second semi-annular shoulders and the arm can be formed as a single integral member.

The centralizing cage is assembled by attaching a first centralizing cage member with an identical second centralizing cage member as indicated in step 210 of the flowchart. Preferably, the centralizing cage is assembled around the bar, although it is possible to preassemble the cages and then slide onto the bar. As discussed above, the centralizing cage includes protrusions extending toward the reinforcing bar. The centralizing cage can be deformed until the protrusions engage an outer surface of the reinforcing bar.

FIGS. 8-13 of U.S. Patent App. Pub. No. 2017/0268235 ('the '235 publication) provide photographs that show the assembly process being performed in the field. The '235 publication is incorporated herein by reference.

Referring to step 215, the centralizing cage secured to the reinforcing bar at a first position along the reinforcing bar. This step can be performed with ties or any other means. Examples of assembled centralizing cages are shown in FIGS. 10, 11A, 11B, 12A, and 12B of the '235 publication. These steps can be repeated for however many centralizing cages are to be used as indicated by step 220.

As an example, the lowest centralizing cage can be installed approximately one foot from the end of the reinforcing bar. Each successive centralizing cage can be placed at intervals of no greater than 10 feet. The upper centralizing cage can be approximately one foot below the grout/concrete surface. FIG. 13 of the '235 publication illustrates a reinforcing bar with several centralizing cages attached thereto.

As indicated by step 225, the reinforcing bar with the attached centralizing cage(s) can then be inserted into the drilled shaft/bore hole. Each centralizing cage keeps the reinforcing bar spaced from walls of the drilled shaft/bore hole. Due to the construction of the centralizing cages, the reinforcing bar is positioned substantially along a central axis of the drilled shaft/bore hole, thus preventing the reinforcing bar from touching sidewalls of the drilled shaft/bore hole.

The drilled shaft/bore hole can then be filled with a fixant to fix the centralizing cage and the reinforcing bar in place within the drilled shaft/bore hole, as indicated by step 230. The fixant can be concrete, grout, mortar or any other material to be used in the particular application. Grout is typically used with soil nails. Bearing plates can then be installed before a final facing is put in place to complete the process.

In other embodiments, the order steps 225 and 230 is reversed. In other words, the drilled shaft/bore hoe can first be filled with fixant and then the reinforcing bar with the attached centralizing cage(s) can then be inserted into the filled drilled shaft/bore hole.

Figure 13A:
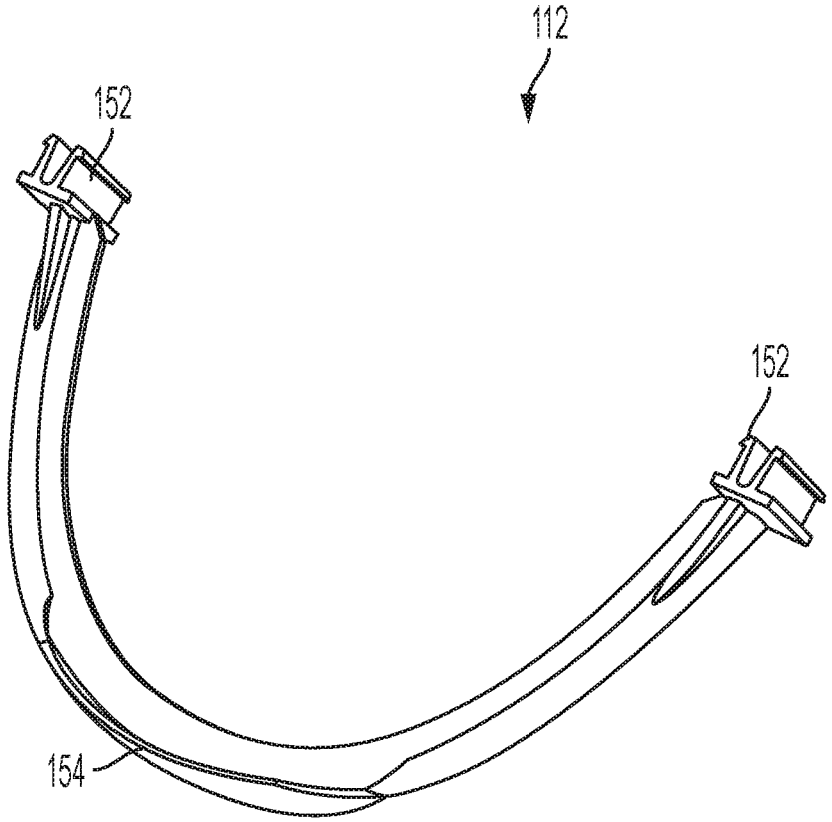
FIGS. 13A-13E, collectively referred to as FIG. 13, show various views of a bow spring or arm.
Figure 13B:
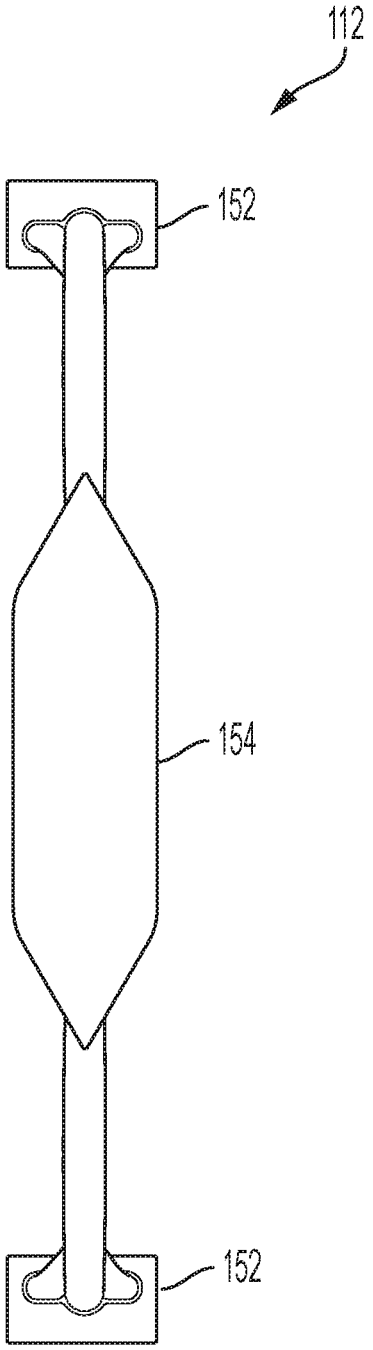
Figure 13C:
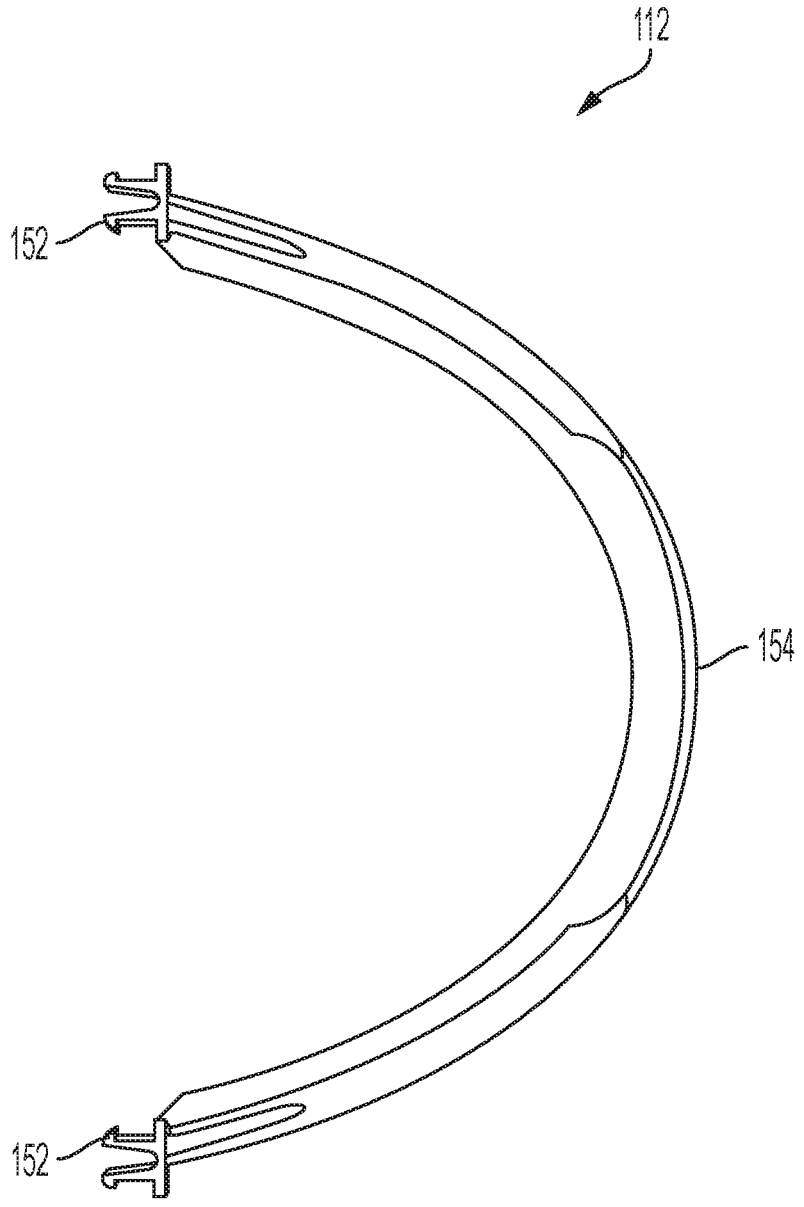
Figure 13D:
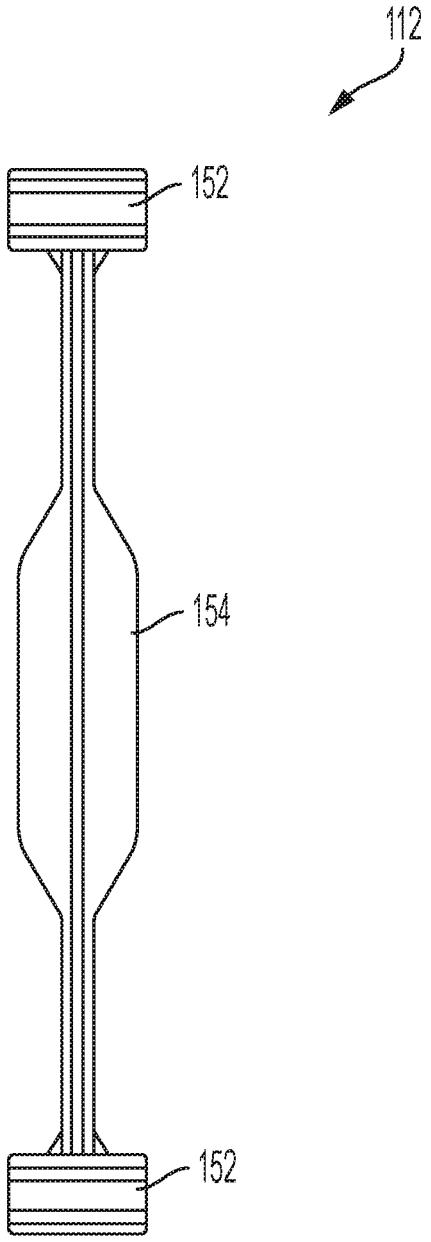
Figure 13E:
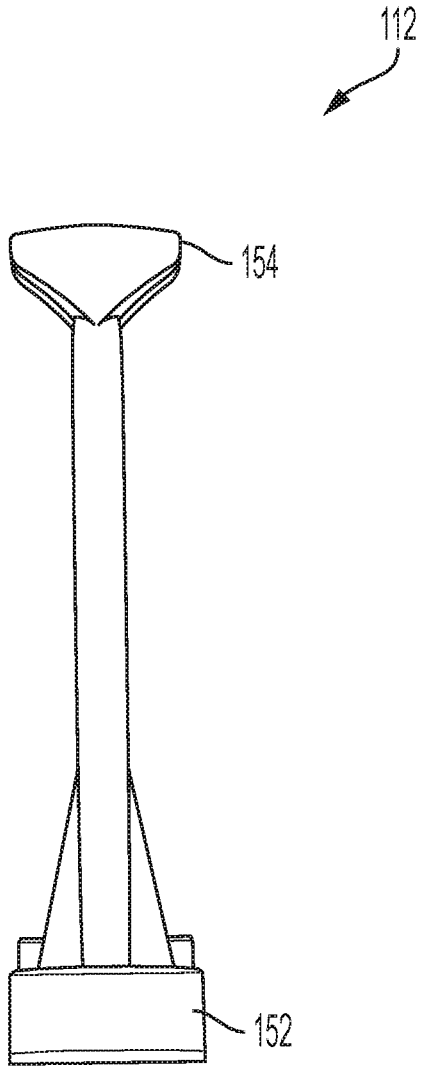
Figure 14:
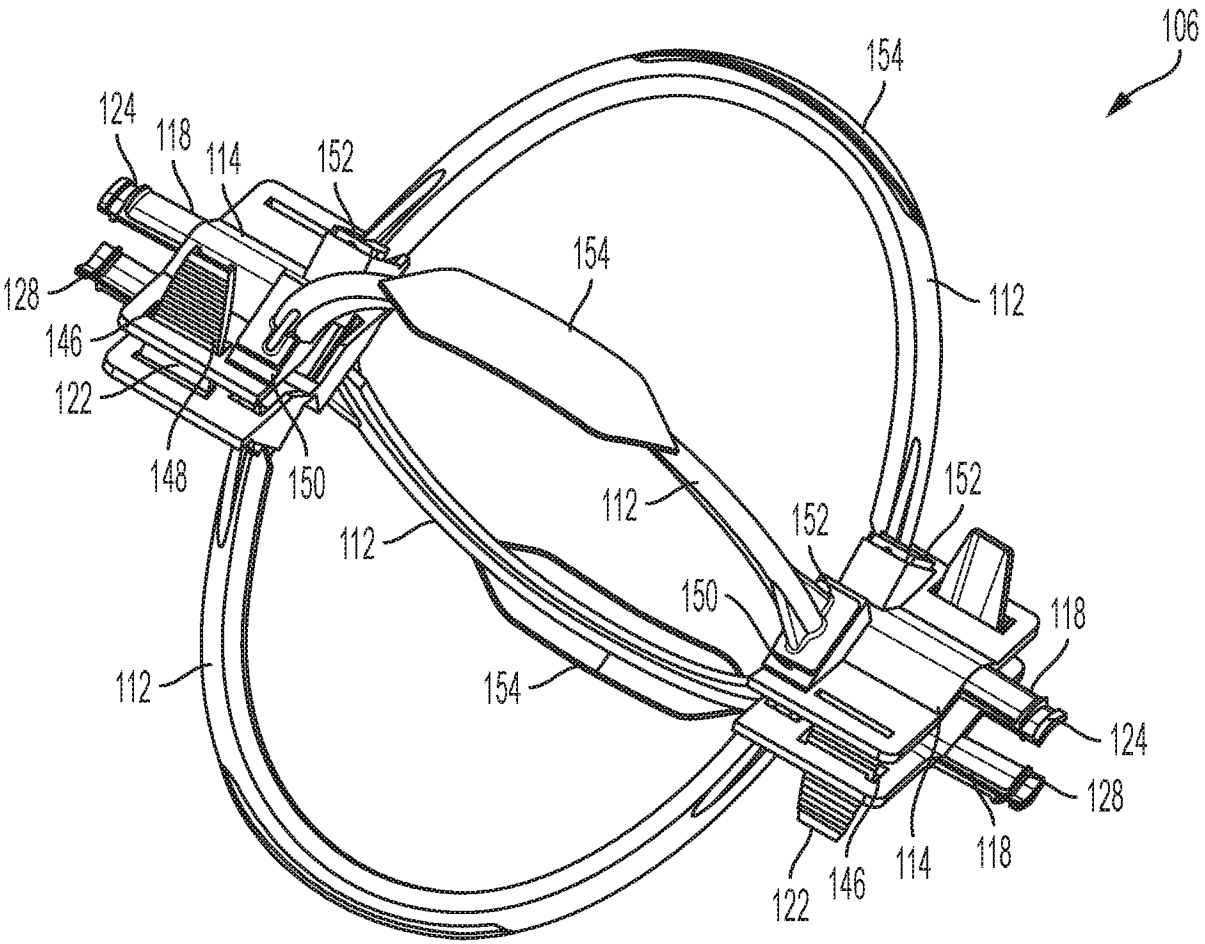
FIG. 14 shows a perspective view of a centralizer.

FIGS. 12-14 show another embodiment for a centralizer cage. This embodiment includes multiple pieces. As will be discussed below, an individual cage member can be formed using two retaining members or hubs (FIG. 12) that are attached with arms or bow springs of different sizes (FIG. 13). The selected arm size is determined by the size of the drilled shaft/bore hole. The cage member can be preassembled before reaching the field. Two cage members can then be utilized as discussed above.

Figure 12A:
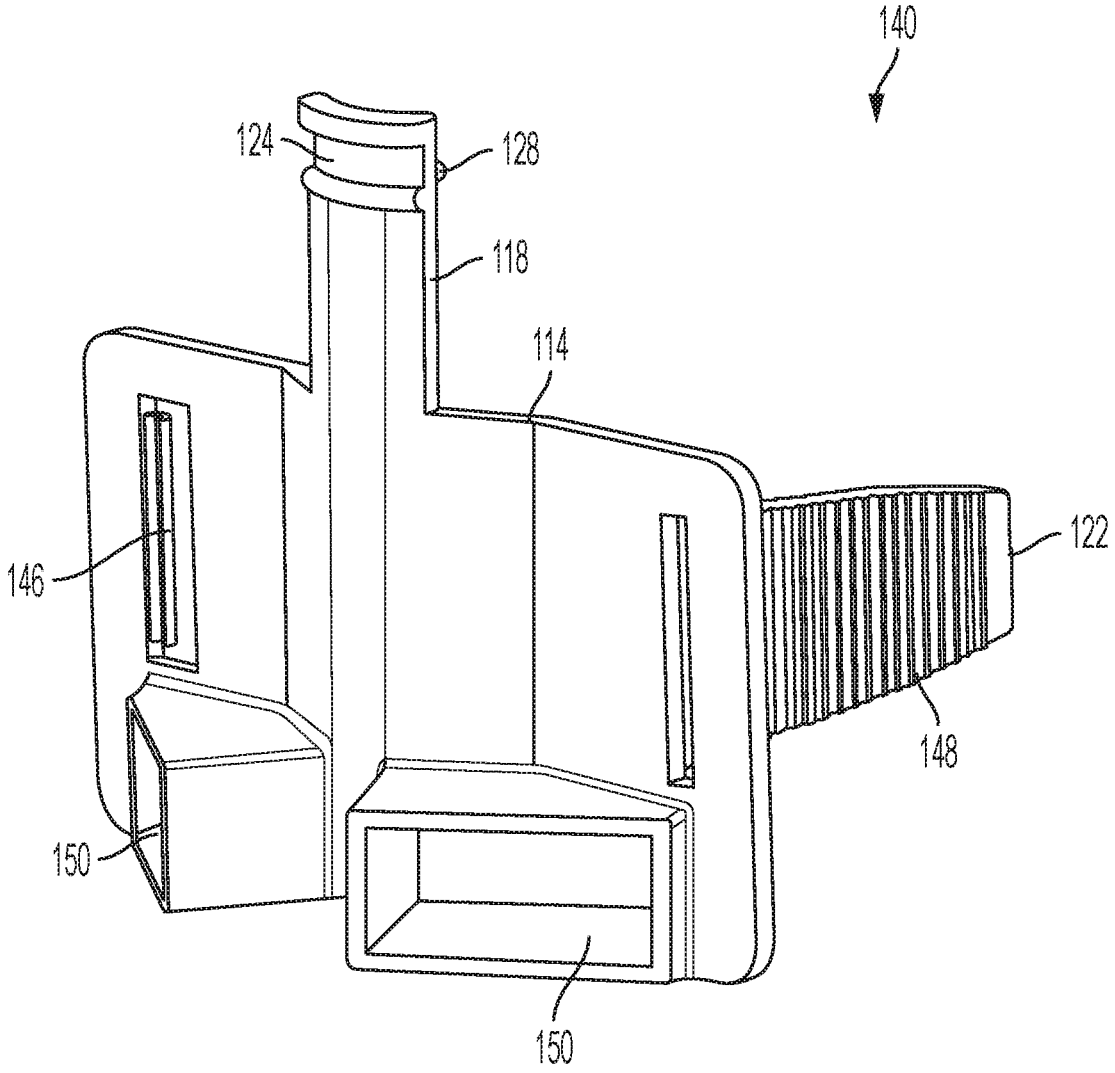
FIGS. 12A-12E, collectively referred to as FIG. 12, show various views of retaining member.
Figure 12B:
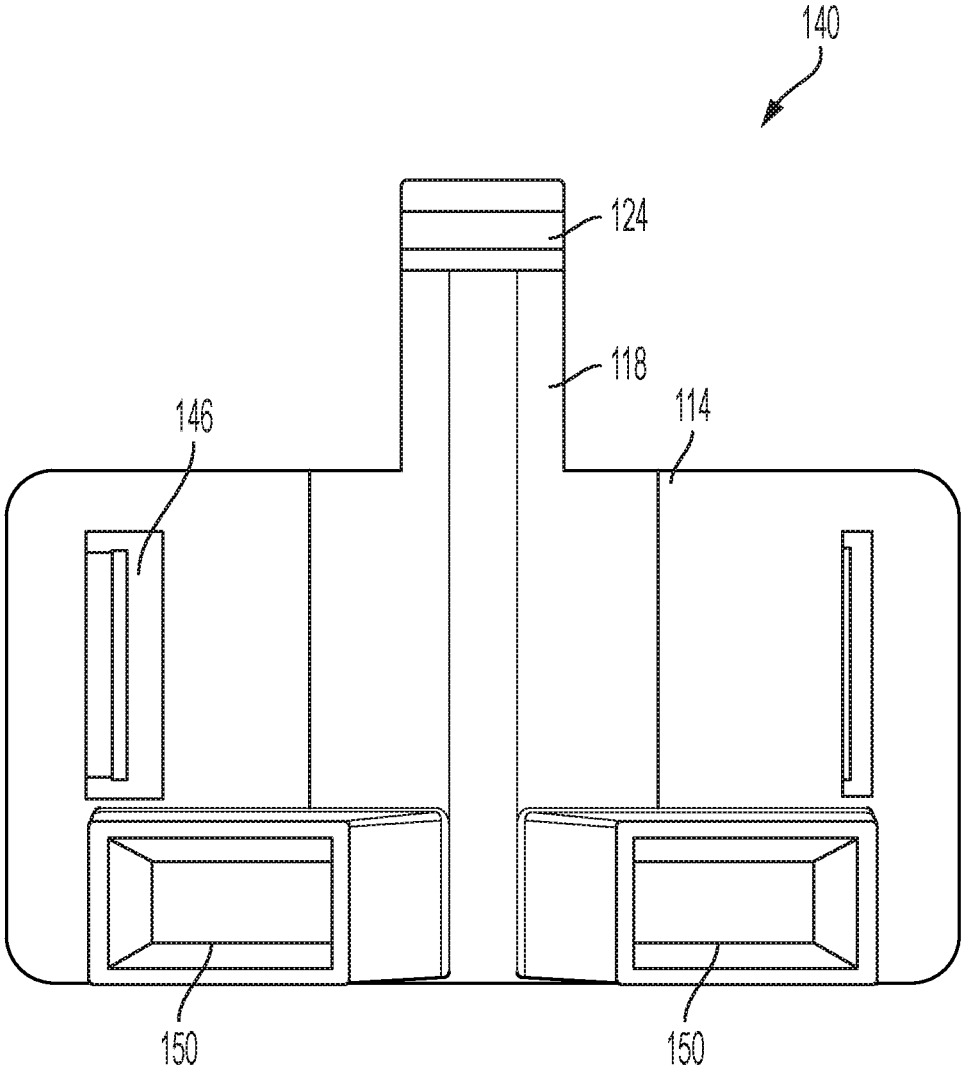
Figure 12C:
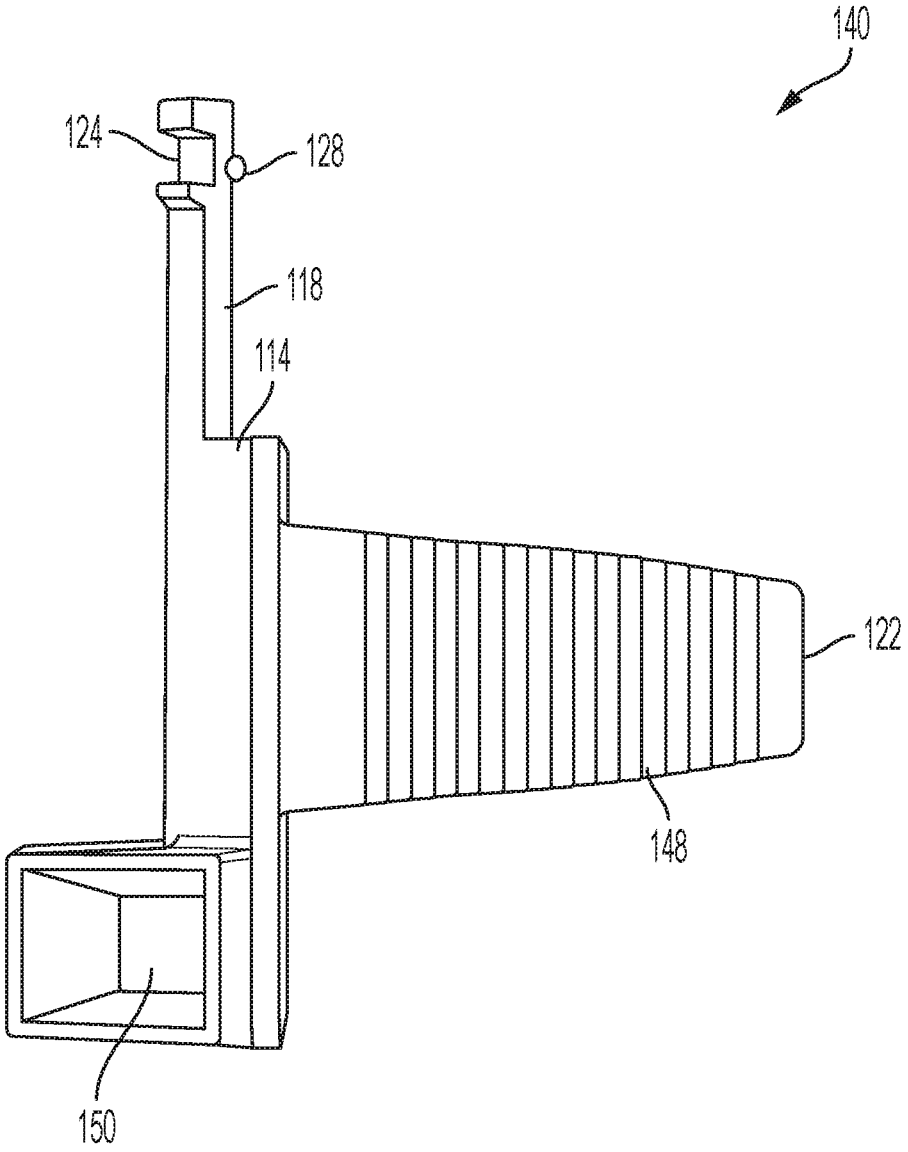
Figure 12D:
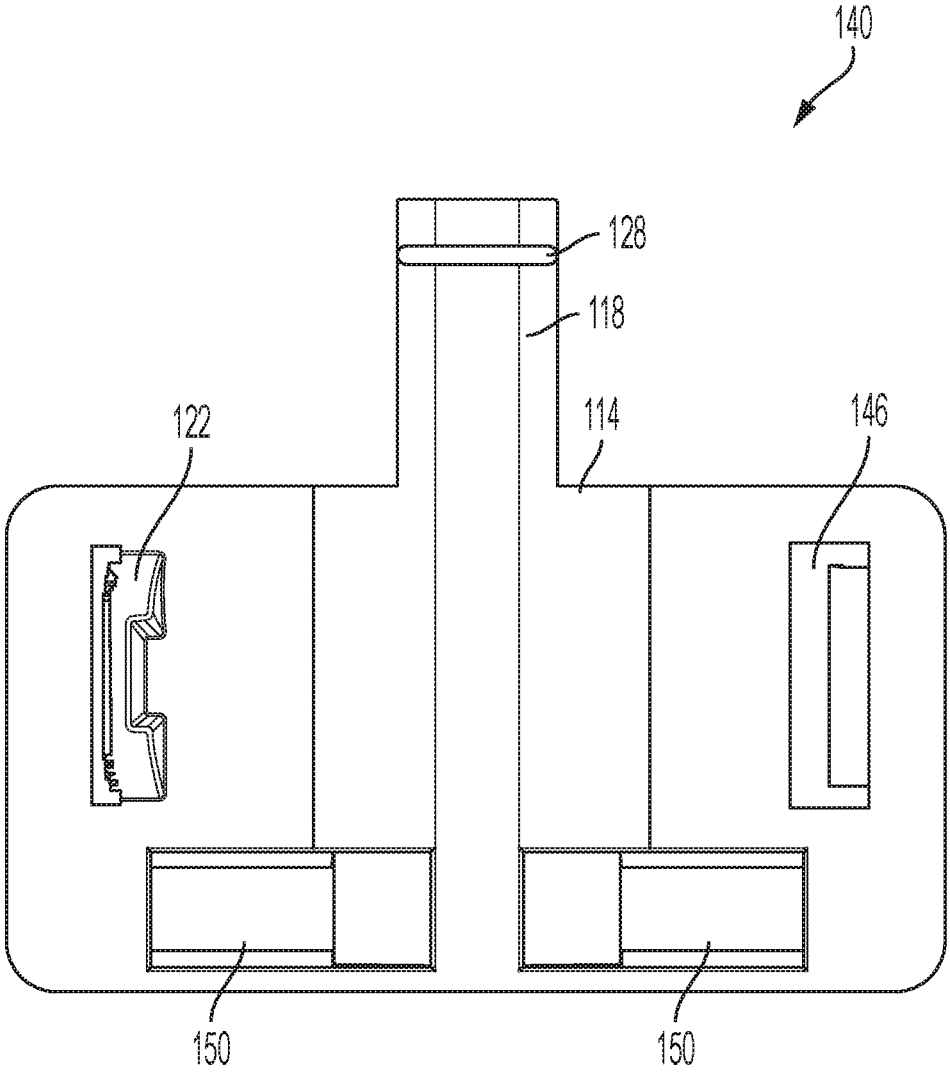
Figure 12E:
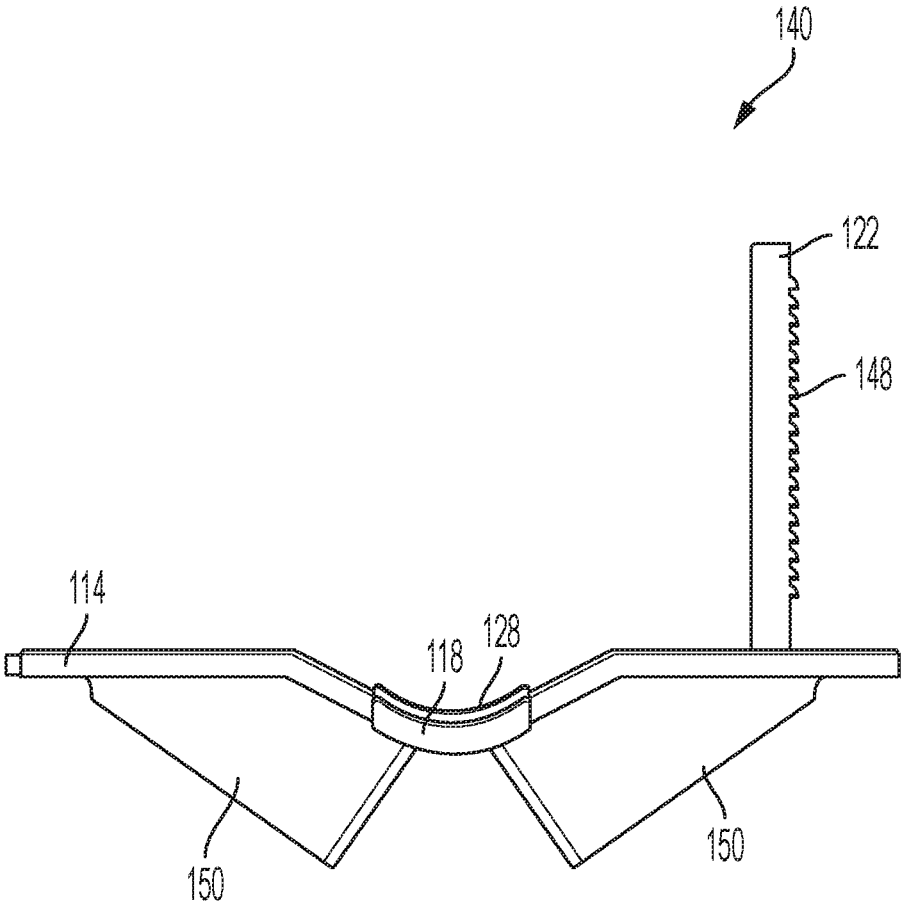

FIG. 12, which includes FIGS. 12A-12E, shows a retaining member 140. FIG. 12A shows a perspective view of the retaining member 140, FIG. 12B shows an outer view of the retaining member 140, FIG. 12C shows a right side view of the retaining member 140, FIG. 12D shows an inner view of the retaining member 140, and FIG. 12E shows a top view of the retaining member 140.

The retaining member is a single member with a plurality of portions, including a neck portion 118 and a collar portion 114 adjacent to the neck portion 118. In this example, the neck portion 118 includes a channel or groove 124 formed on an outer surface and a protrusion 128 on the inner surface. An elongated tab 122 extends from a region adjacent a first lateral edge of the collar portion 114 and includes a plurality of teeth 148. A slot 146 extends from a region adjacent a second lateral edge of the collar portion 114. The second lateral edge is spaced from the first lateral edge by the collar portion 114. In this example, sockets 150 are on the collar portion 114 opposite of the neck portion 118. The socket 150 is configured to receive a centralizer arm 112 shown in FIG. 13.

The retaining member 140 is formed symmetrically so that the retaining member 140 can be interlocked with a substantially identical retaining member. The elongated tab 122 of the retaining member 140 is configured to join with the slot 126 of the substantially identical retaining member. In this example, the slots and tabs 122 and 146 are arranged on opposite sides so that when two retaining members are brought together, the tab 122 will fit within the slot 146. In some embodiments, the identical retaining members 140 are removably connected to each other. In alternative embodiments, the identical retaining members 140 are permanently connected to each other.

FIG. 13, which includes FIGS. 13A-13E, shows an embodiment of a centralizer arm or bow 112. FIG. 13A shows a perspective view of the centralizer arm 112, FIG. 13B shows an outer view of the centralizer arm 112, FIG. 13C shows a side view of the centralizer arm 112, FIG. 13D shows an inner view of the centralizer arm 112, and FIG. 13E shows a top or bottom view of a centralizer arm 112.

The centralizer arm 112 includes fasteners 152 that extend from each end of the centralizer arm 112. The fasteners 152 are configured to connect with the sockets 150 of the retaining member 140 of FIG. 12. The fasteners 152 are formed identically on both ends of the centralizer arm 112 to fit with the sockets 150 of substantially identical retaining members 140.

The centralizer arm 112 may be selected at various lengths and radius of curvatures to accommodate different diameter holes and drilling depths. The centralizer arms 112 may also have various thicknesses or widths to assist in guiding the centralizing cage 106 into a bore hole. In some embodiments, the fastener 152 is removably connected to the socket 150. In alternative embodiments, the fastener 152 is permanently connected to the socket 150.

As shown most clearly in FIG. 13B, the centralizing arm 112 includes a widened portion 154. Each of the embodiments disclosed herein can be modified to include such a portion 154. The widened portion 154 can be helpful, for example, in assembling the cage member. The portion 154 may also make it easier for the assembled centralizer to slide down the walls of the bore hole/drill shaft.

FIG. 14 shows a third embodiment of a centralizing cage 106. This cage is similar to the centralizing cage 106 described with respect to FIG. 3 and FIG. 7, and, as such, common aspects will not be described again. It is understood that variation shown in each of the embodiment can be interchanged.

FIG. 14 shows centralizing cage members 130 (132) that are combined to form a centralizing cage 106. In this example, the centralizing cage members 130 (132) are formed with the retaining member shown in FIG. 12 and the centralizer arm 112 shown in FIG. 13. The retaining members 140 and the centralizer arms 112 are joined by connecting the fasteners 152 of the centralizer arms 112 to the sockets 150 of the retaining members 140. In this embodiment, for example, the centralizing cage members 130 (132) are formed by four retaining members of FIG. 12 and four centralizer arms of FIG. 13. Two of the retaining members 140 and two centralizer arms 112 form one centralizing cage member 130 and the other two retaining members 140 and two centralizer arms 112 form an identical centralizing cage member 132. It is noted that specific embodiment shown in FIG. 14 merely provides an example.

In the embodiment of FIG. 14, the arms 112 are connected directly to the retaining members 140. In another embodiment, the arms 112 can be connected to the retaining member by an extender 160. The advantage of including an extender is that is necessary to stock (and build a mold for) only one size arm. Applications that need a longer arm can utilize the extender. Basically we have a base bow of 10-11" and this bow can be extended by using a 2" extender or a 3" extender or for that matter it can be extended to any length using any combination of the extenders.

Figure 15A:
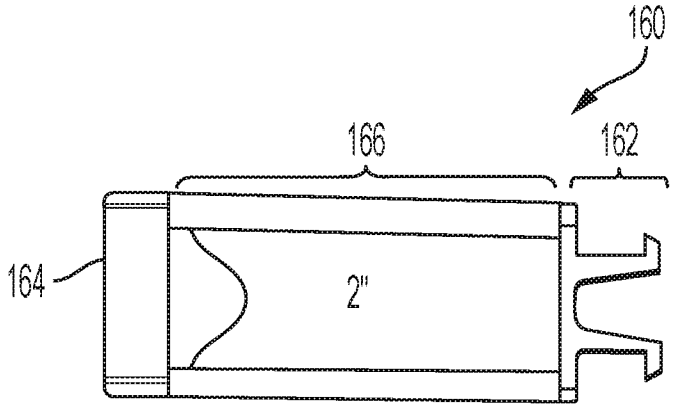
FIGS. 15A-15B, collectively referred to as FIG. 15, show two examples of an extender that can be used between a retaining member and an arm.
Figure 15B:
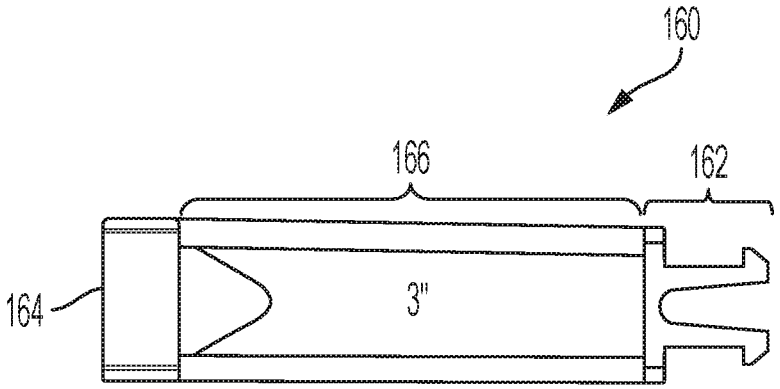

FIGS. 15A and 15B show a two inch and a three inch extender, respectively. These are just two possible options. For example, one might choose to fabricate only one inch and two inch extenders and then utilize two extenders for a three inch or four inch extension. In general, any size extender is possible. For example, an arm (or base bow) of 10-11" can be extended by using a 2" extender or a 3" extender. For that matter, the arm can be extended to any length using any combination of the extenders.

As shown in the figure, the extender 160 includes a fastener 152 that extends from an each end of the extender body 166. A socket 164 extends from the other end of the extender body 166. The fastener 162 is configured to connect with the socket 150 of the retaining member 140 or the socket 164 of another extender. Similarly, the socket 164 is configured to receive the fastener 152 of the arm 112 or the fastener 162 of another extender 160. Use of the extender 160 allows a single centralizer arm 112 to be modified to various lengths and radius of curvatures to accommodate different diameter holes and drilling depths. In some embodiments, the fastener 162 is removably connected to the socket 150 and, in other embodiments, the fastener 162 is permanently connected to the socket 150.

Figure 16A:
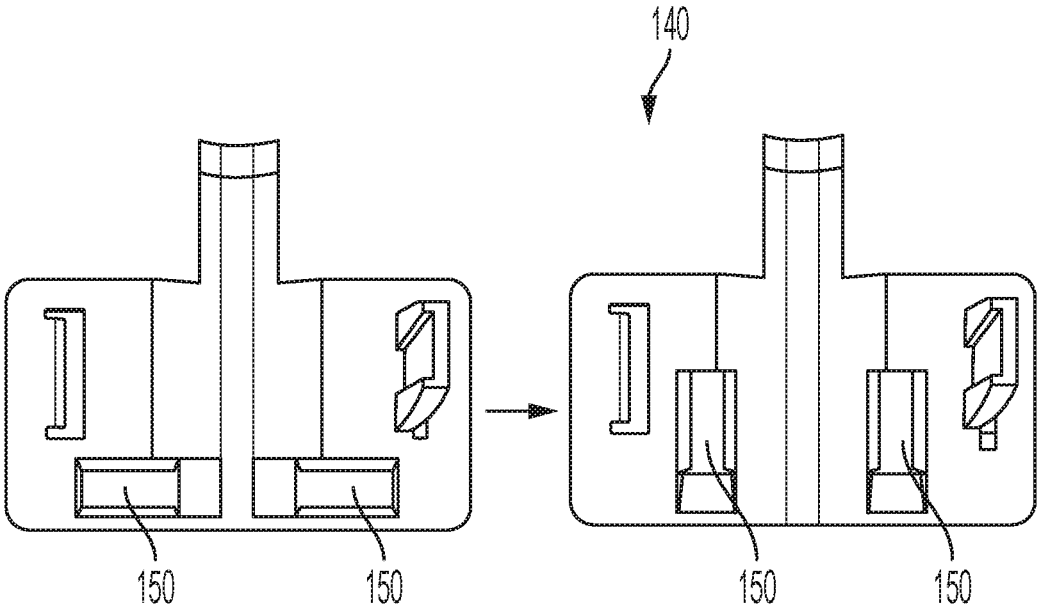
FIGS. 16A-16C, collectively referred to as FIG. 16, show modifications of the retaining member, centralizer arm and extender according to another embodiment.
Figure 16B:
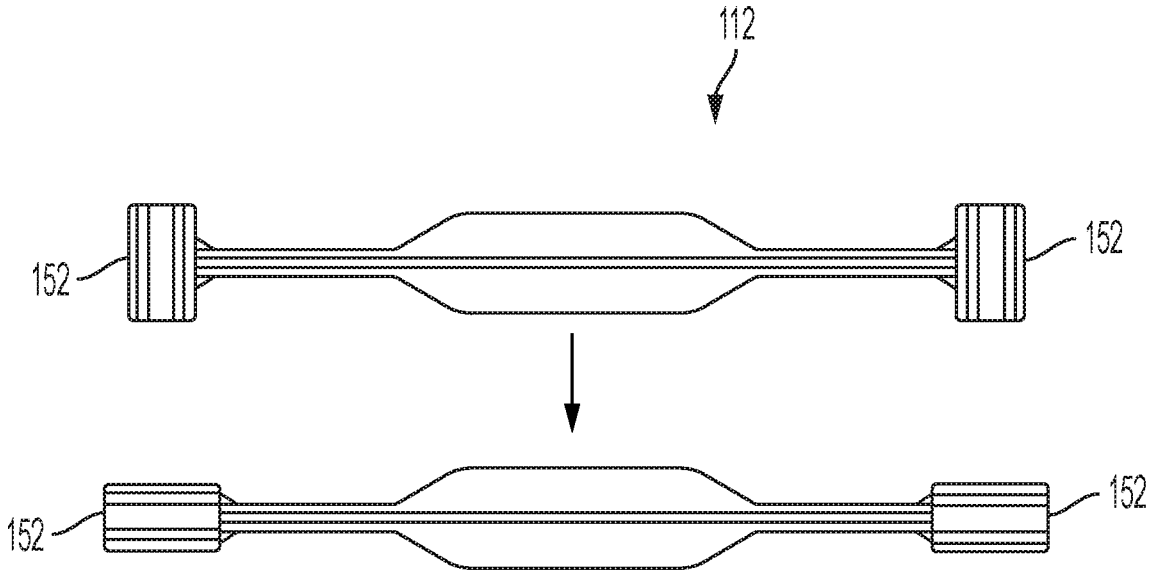
Figure 16C:
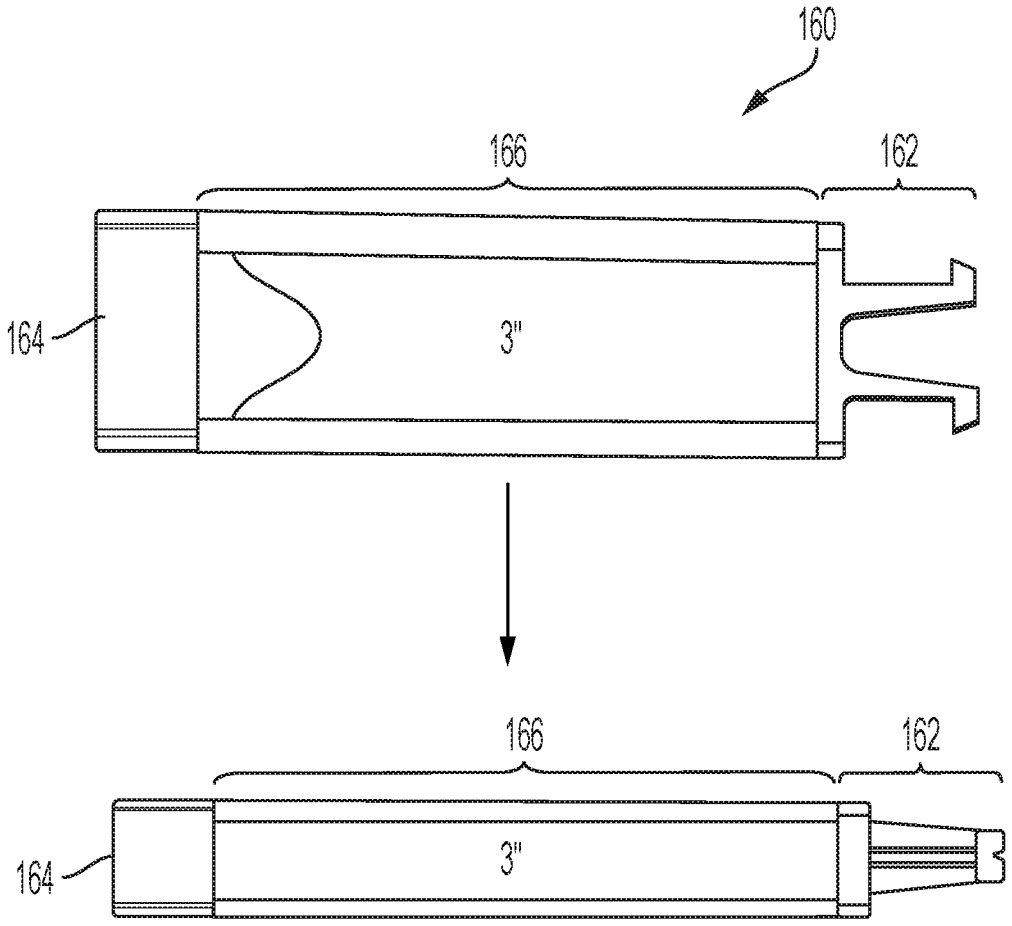
Figure 17A:
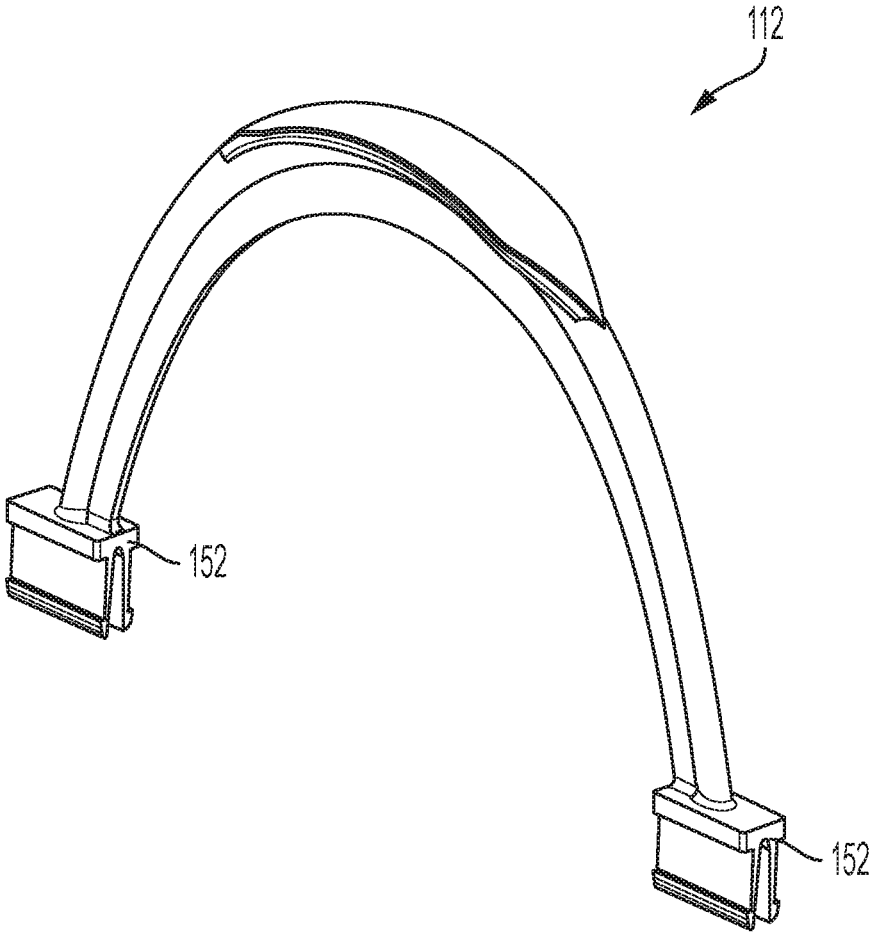
FIGS. 17A-17B, collectively referred to as FIG. 17, show a retaining member and an arm of the modified embodiment.
Figure 17B:
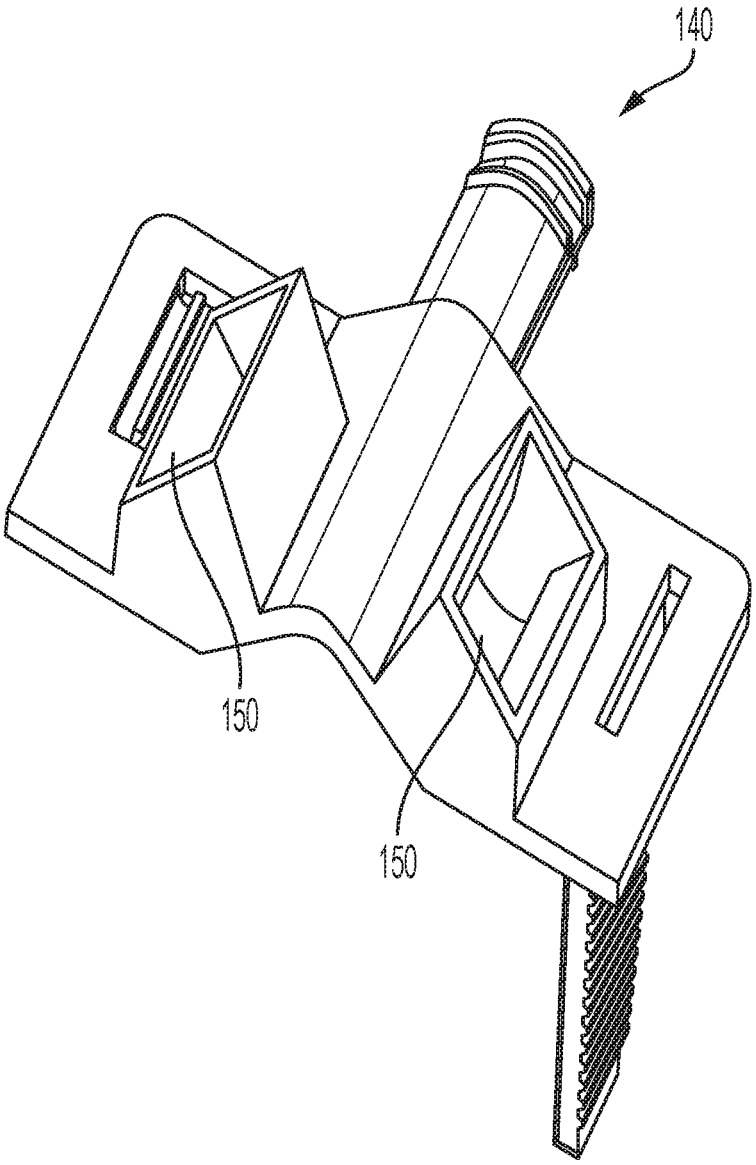

FIG. 16, which includes FIGS. 16A-16C, illustrates another embodiment. As shown in FIG. 16A, the orientation of the socket 150 (or bow receptor) located on the collar of the retaining member is rotated by 90 degrees. Similarly, as shown in FIG. 16B, the fastener 152 of the centralizer arm (or bow spring) is rotated by 90 degrees. If used, the fastener 162 and socket 164 of the extender 160 will also be rotated by 90 degrees to fit between the retaining member 140 (or hub) and the arm 112 (or bow spring) as shown in FIG. 16C. The centralizer arm 112 and retaining member 140 of this embodiment are shown in FIGS. 17A and 17B, respectively.

This orientation can be helpful in applications wherein the centralizer and reinforcing member are inserted in a bore hole/drill shaft into which the grout which has been previously placed. Rotating the centralizer connections by 90 degrees can provide less resistance when the reinforcing member and centralizers are placed in the high strength grout.

Figure 18:
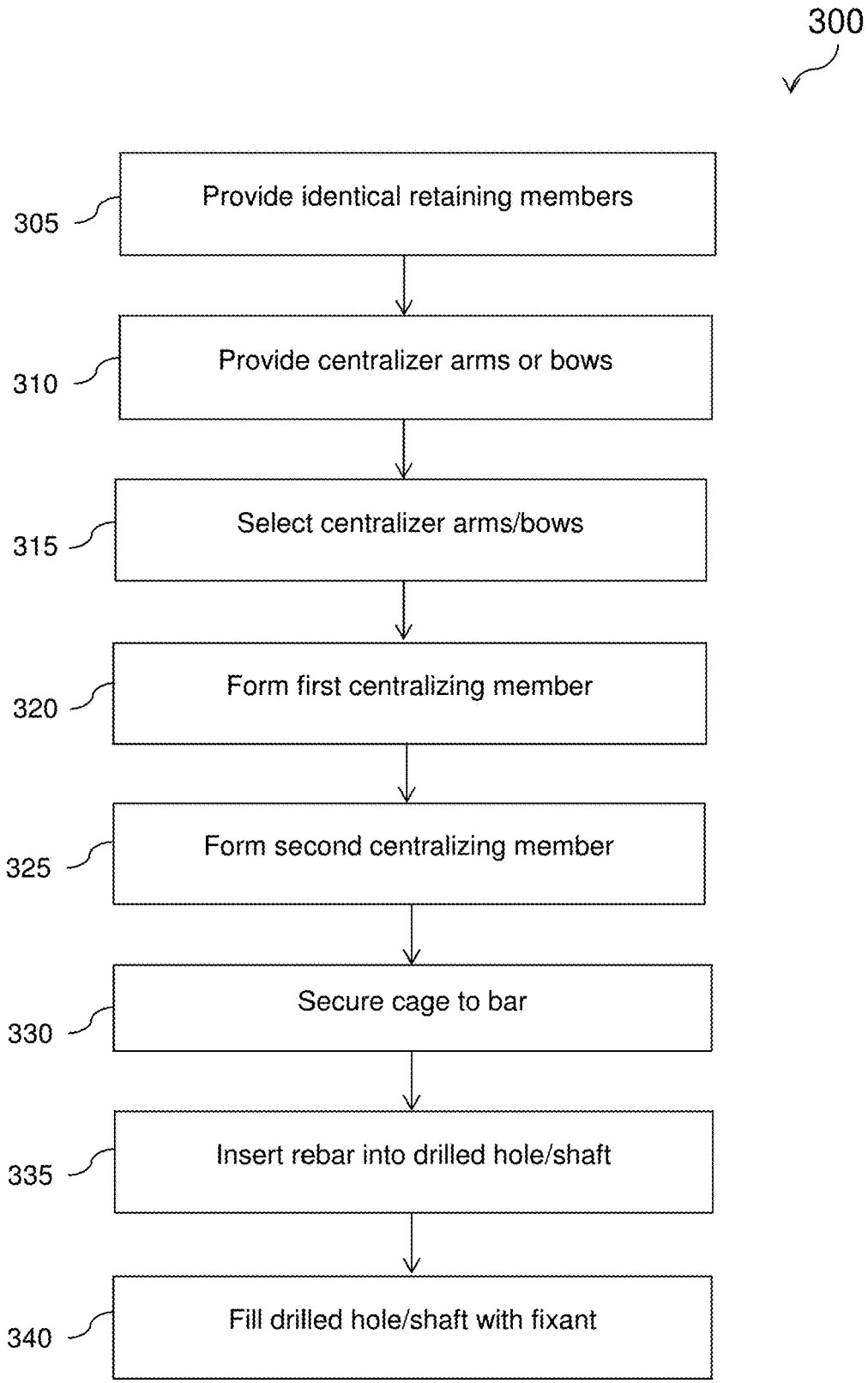
FIG. 18 is a flowchart summarizing steps in utilizing the centralizer.

FIG. 18 provides a flowchart illustrating a method of forming the centralizing cage 106 with retaining members 140 and arms or bows 112 of the embodiment discussed herein. This example provides a method for centering a reinforcing bar 102 within a drilled shaft/bore hole 104. A number of substantially identical retaining members are provided as shown in step 305. These members may be as described above. For example, each retaining member includes a neck portion, a collar portion adjacent the neck portion, and a plurality of sockets on the collar portion. The retaining member may be a single integral member. A number of centralizer arms or bows are provided as shown in step 310. These members may be described as above. For example, each centralizer arm includes fasteners on a first end and on a second end of the centralizer arms or bows. The centralizer arms or bows may have various lengths, thicknesses, and radius of curvatures. The centralizer arms or bows with the length, width, and radius of curvature as needed are selected in step 315. The centralizer arms or bows may be a single integral member. While not shown in the flow chart, extenders of various sizes can also be provided.

The first centralizing member is assembled by attaching the fasteners on the first end of the arms to the sockets of the retaining member and subsequently attaching the fasteners on the second end of the arms to another retaining member in step 320. The second centralizing member is assembled, in step 3 as described for the first centralizing member. Once again, the arms can be connected directly to the retaining member or connected via an extender. These proceeding steps can be performed at the work site or at a warehouse before shipment to the work site.

The centralizing cage is assembled, in step 330, by attaching the first centralizing member with the second centralizing member assembled in steps 320 and 325 of the flowchart. The remaining steps 330, 335, and 340 can be performed as discussed in steps 215, 220, 225 of FIG. 11.

It should be appreciated that the centralizing cages 106 may be used in any of the following processes: Auger Cast Pile, Auger Cast-in-Place Pile, Auger Grouted Cast in Place Pile (ACIP), Auger Grouted Pile, Auger Pile, Battered Piles, Bored Piles, Caissons, Cast-In-Drilled-Holes Piles/Piers (CIDH), Cast-In-Place Piles/Piers, Cast-In-SITU Piles, Continuous Flight Auger Pile (CFA), Drill Displacement Pile, Drilled Piers, Drilled Shafts, Franki Piles (PIF), Fundex Screw Piles, Ground Anchors, Grouted tiebacks, Inclined Tiebacks, Laterally Loaded Piles, Macropiles, Micropiles, Minipiles, Needle piles, Omega Screw Piles, Pin piles, Rock Anchors, Root piles, Screw Piers, Screw Piles, Soil Nails, Soil Anchors, Soil Tiebacks, Tensile Anchors, Tie Back Anchors, Tie Down Anchors, Tieback Anchors, Tie-back Anchors, Tiebacks, Tiedown Anchors, Under-Reamed Pile or in any application in which a single rebar rod/member needs to be centralized in a drilled shaft/bore hole in any orientation.

As discussed above, embodiments of the invention include a number of advantages. For example, embodiments can include some or all of the following:

- two identical halves
- easy to snap together
- made of durable non-corrosive plastic
- can be attached with zip ties or tie wire
- offset to fit between rebar threads
- keeps single tendon/bar centered within a drill hole
- ideal for soil nail applications
- no nuts or bolts required
- light weight and economical The parent application and its corresponding provisional application as well as the non-provisional and provisional applications from which this patent claims the benefit include additional figures and an appendix to illustrate further views of the centralizer, first prior to assembly and then with two halves assembled together. The views in that filing are incorporated herein by reference along with the rest of the application.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A centralizer for use in a system for centering a reinforcing member within a drilled shaft/bore hole, the reinforcing member extending along a center axis, the centralizer comprising:

- a first retaining member comprising a single integral member that includes:
  - a first neck portion having a concave shape relative to the center axis;
  - a first collar portion adjacent the first neck portion and including a plurality of sockets extending outwardly relative to the center axis;
  - a first protrusion adjacent the first neck portion or the first collar portion and extending inwardly toward the center axis, the first protrusion configured to engage the reinforcing member when the centralizer is in use;
  - a first elongated tab extending from a region adjacent a first lateral edge of the first collar portion, the first elongated tab including a plurality of teeth; and
  - a first slot extending from a region adjacent a second lateral edge of the first collar portion, the second lateral edge spaced from the first lateral edge by the first collar portion;
- a second retaining member comprising a single integral member that includes:
  - a second neck portion having a concave shape relative to the center axis;
- a second collar portion adjacent the second neck portion and including a plurality of sockets extending outwardly relative to the center axis;
  - a second protrusion adjacent the second neck portion or the second collar portion and extending inwardly toward the center axis, the second protrusion configured to engage the reinforcing member when the centralizer is in use;
  - a second elongated tab extending from a region adjacent a first lateral edge of the second collar portion, the second elongated tab including a plurality of teeth; and
  - a second slot extending from a region adjacent a second lateral edge of the second collar portion, the second lateral edge spaced from the first lateral edge by the second collar portion;
- a third retaining member comprising a single integral member that includes:
  - a third neck portion having a concave shape relative to the center axis;
  - a third collar portion adjacent the third neck portion and including a plurality of sockets extending outwardly relative to the center axis;
  - a third protrusion adjacent the third neck portion or the third collar portion and extending inwardly toward the center axis, the third protrusion configured to engage the reinforcing member when the cage member is in use;

a third elongated tab extending from a region adjacent a first lateral edge of the third collar portion, the third elongated tab including a plurality of teeth; and a third slot extending from a region adjacent a second lateral edge of the third collar portion, the second lateral edge spaced from the first lateral edge by the third collar portion;

a fourth retaining member comprising a single integral member that includes:

a fourth neck portion having a concave shape relative to the center axis;

a fourth collar portion adjacent the fourth neck portion and including a plurality of sockets extending outwardly relative to the center axis;

a fourth protrusion adjacent the fourth neck portion or the fourth collar portion and extending inwardly toward the center axis, the fourth protrusion configured to engage the reinforcing member when the cage member is in use;

a fourth elongated tab extending from a region adjacent a first lateral edge of the fourth collar portion, the fourth elongated tab including a plurality of teeth; and a fourth slot extending from a region adjacent a second lateral edge of the fourth collar portion, the second lateral edge spaced from the first lateral edge by the fourth collar portion; and a first plurality of separate arms, each arm of the first plurality extending in the direction along the center axis and having a first end secured in a socket of the first retaining member and a second end secured in a socket of the second retaining member; and a second plurality of separate arms, each arm of the second plurality extending in the direction along the center axis and having a first end secured in a socket of the third retaining member and a second end secured in a socket of the fourth retaining member;

wherein the first elongated tab is connected within the third slot at so a first number of the plurality of teeth are on one side of the third slot and a remaining number of the plurality of teeth are on a opposite side of the third slot, the ratio of the first number to the remaining number of teeth of the first elongated tab being determined by a diameter of the reinforcing member;

wherein the third elongated tab is connected within the first slot at so a first number of the plurality of teeth are on one side of the first slot and a remaining number of the plurality of teeth are on a opposite side of the first slot, the ratio of the first number to the remaining number of teeth of the third elongated tab being substantially the same as the ratio of the first number to the remaining number of teeth of the first elongated tab;

wherein the second elongated tab is connected within the fourth slot at so a first number of the plurality of teeth are on one side of the fourth slot and a remaining number of the plurality of teeth are on a opposite side of the fourth slot, the ratio of the first number to the remaining number of teeth of the second elongated tab being determined by a diameter of the reinforcing member; and wherein the fourth elongated tab is connected within the second slot at so a first number of the plurality of teeth are on one side of the second slot and a remaining number of the plurality of teeth are on a opposite side of the second slot, the ratio of the first number to the remaining number of teeth of the fourth elongated tab being substantially the same as the ratio of the first number to the remaining number of teeth of the second elongated tab.

2. The centralizer of claim 1, wherein a first channel is formed in an outer surface of the first neck portion, a second channel is formed in an outer surface of the second neck portion, a third channel is formed in an outer surface of the third neck portion, and a fourth channel is formed in an outer surface of the fourth neck portion.

3. The centralizer of claim 1, further comprising a first set of flanges extending from the first collar portion, a second set of flanges extending from the second collar portion, a third set of flanges extending from the third collar portion, and a fourth set of flanges extending from the fourth collar portion.

4. The centralizer of claim 1, wherein the plurality of arms curve in an outward direction from the first, second, third, and fourth collar portions, the outward direction being away from the center axis.

5. The centralizer of claim 1, wherein the arms are equally spaced along a circumference of a circle extending through the center axis.

6. The centralizer of claim 1, wherein the first protrusion extends from an inner surface of the first neck portion, the second protrusion extends from an inner surface of the second neck portion, the third protrusion extends from an inner surface of the third neck portion, and the fourth protrusion extends from an inner surface of the fourth neck portion.

7. The centralizer of claim 1, wherein the first protrusion extends from an inner surface of the first collar portion, the second protrusion extends from an inner surface of the second collar portion, the third protrusion extends from an inner surface of the third collar portion, and the fourth protrusion extends from an inner surface of the fourth collar portion.

8. A centralizer arrangement having a plurality of components that are connectable for use in a system for centering a reinforcing member within a drilled shaft/bore hole, the reinforcing member extending along a center axis, the centralizer arrangement comprising:

a plurality of retaining members, each retaining member comprising a single integral member that includes:

a neck portion having a concave shape relative to the center axis;

a collar portion adjacent the neck portion and including a plurality of sockets extending outwardly relative to the center axis;

a protrusion adjacent the neck portion or the collar portion and extending inwardly toward the center axis, the protrusion configured to engage the reinforcing member when the centralizer is in use;

an elongated tab extending from a region adjacent a first lateral edge of the collar portion, the elongated tab including a plurality of teeth; and a slot extending from a region adjacent a second lateral edge of the collar portion, the second lateral edge spaced from the first lateral edge by the collar portion;

a first plurality of separate arms, each arm having a first end connectable in a socket of the collar portion and a second end connectable in a socket of the collar portion, each arm of the first plurality of separate arms having a first radius of curvature; and a second plurality of separate arms, each arm having a first end connectable in a socket of the collar portion and a second end connectable in a socket of the collar portion, each arm of the second plurality of separate arms having a second radius of curvature that is different than the first radius of curvature;

wherein four retaining members, including first, second, third and fourth retaining members, are connectable with a plurality of arms to form a centralizer for a specific combination of a reinforcing member and a drilled shaft/bore hole, the centralizer configured so the neck portions and collar portions of the four retaining members surround the reinforcing member and the arms extending in the direction along the center axis and curve outward away from the reinforcing member;

wherein the plurality of arms to form the centralizer are all arms selected from the first plurality of arms or all arms selected from the second plurality of arms, the selection based on a radius of the drilled shaft/bore hold; and wherein the four retaining members are connectable by inserting the elongated tab of the first retaining member into the slot of the second retaining member by a first distance, inserting the elongated tab of the second retaining member into the slot of the first retaining member by the first distance, inserting the elongated tab of the third retaining member into the slot of the fourth retaining member by the first distance, and inserting the elongated tab of the fourth retaining member into the slot of the third retaining member by the first distance, the first distance being based on a diameter of the reinforcing member.

9. The centralizer arrangement of claim 8, wherein each arm of the first plurality of separate arms has a first length and wherein each arm of the second plurality of separate arms has a second length that is different than the first length.

10. The centralizer arrangement of claim 8, wherein, when connected, the sockets of the four retaining members and the arm portions are equally spaced along a circumference of a circle extending through the center axis.

11. The centralizer arrangement of claim 8, wherein the four retaining members and the selected arms are connected to form the centralizer.

12. A method for using a centralizing cage system to centralize a reinforcing member along a center axis within a drilled shaft/bore hole, the reinforcing member extending along a center axis, the method comprising:

providing a plurality of substantially identical retaining members, each retaining member comprising a single integral member that includes:

a neck portion having a concave shape relative to the center axis;

a collar portion adjacent the neck portion and including a plurality of sockets extending outwardly relative to the center axis;

a protrusion adjacent the neck portion or the collar portion and extending inwardly toward the center axis, the protrusion configured to engage the reinforcing member when the centralizer is in use;

an elongated tab extending from a region adjacent a first lateral edge of the collar portion, the elongated tab including a plurality of teeth; and a slot extending from a region adjacent a second lateral edge of the collar portion, the second lateral edge spaced from the first lateral edge by the collar portion;

providing a first plurality of separate arms, each arm having a first end connectable in a socket of the collar portion and a second end connectable in a socket of the collar portion, each arm of the first plurality of separate arms having a first radius of curvature; and providing a second plurality of separate arms, each arm having a first end connectable in a socket of the collar portion and a second end connectable in a socket of the collar portion, each arm of the second plurality of separate arms having a second radius of curvature that is different than the first radius of curvature;

selecting a plurality of centralizer arms based on diameter of the drilled shaft/bore hole, wherein the plurality of arms to form the centralizer are all arms selected from the first plurality of arms or all arms selected from the second plurality of arms, the number of selected centralizer arms being equal to twice the number of sockets in the collar portion of each retaining member;

connecting half of the selected centralizer arms between a first retaining member and a second retaining member to form a first centralizing member, the first ends of the selected centralizer arms being connected to respective sockets of the first retaining member and the second ends of the selected centralizer arms being connected to respective sockets of the second retaining member;

connecting the remaining half of the selected centralizer arms between a third retaining member and a fourth retaining member to form a second centralizing member, the first ends of the remaining centralizer arms being connected to respective sockets of the third retaining member and the second ends of the selected centralizer arms being connected to respective sockets of the fourth retaining member;

surrounding a first half of the reinforcing member with the first centralizing member and surrounding a second half of the reinforcing member with the second centralizing member; and connecting the first centralizing member and the second centralizing member around the reinforcing member by a distance based on the diameter of the reinforcing member, the distance determined a number of teeth of the elongated tabs that are inserted in respective slots.

13. The method of claim 12, further comprising attaching the interlocked first and second centralizing members to the reinforcing member.

14. The method of claim 13, further comprising repeating the steps of selecting a plurality of centralizer arms, connecting half of the selected centralizer arms, connecting the remaining half of the selected centralizer arms, surrounding the reinforcing member, connecting the first and second centralizing members, and attaching the interlocked first and second centralizing members.

15. The method of claim 12, wherein each arm of the first plurality of separate arms has a first length and wherein each arm of the second plurality of separate arms has a second length that is different than the first length.

16. The method of claim 12, wherein, after connecting the first centralizing member and the second centralizing member around the reinforcing member, the selected centralizer arms are equally spaced along a circumference of a circle extending through the center axis.

17. The method of claim 12, wherein the neck portion of each retaining member includes a first channel formed in an outer surface thereof.

18. The method of claim 12, wherein the collar portion of each retaining member includes a set of flanges extending therefrom.

19. The method of claim 12, wherein the protrusion of each retaining member extends from an inner surface of the neck portion.

20. The method of claim 12, wherein the protrusion of each retaining member extends from an inner surface of the collar portion.

* * * * *